US009469999B1

(12) United States Patent
Aboukhalil

(10) Patent No.: US 9,469,999 B1
(45) Date of Patent: Oct. 18, 2016

(54) EXTERIOR WALL PANNELING SYSTEM

(71) Applicant: WALL PANEL SYSTEMS, INC., Redlands, CA (US)

(72) Inventor: Charbel Tannious Aboukhalil, Grand Terrace, CA (US)

(73) Assignee: Wall Panel Systems, Inc., Redlands, CA (US)

( * ) Notice: Subject to any disclaimer, the term of this patent is extended or adjusted under 35 U.S.C. 154(b) by 0 days.

(21) Appl. No.: 14/701,351

(22) Filed: Apr. 30, 2015

(51) Int. Cl.

| | |
|---|---|
| ***E04B 2/30*** | (2006.01) |
| ***E04F 13/08*** | (2006.01) |
| ***E04B 1/41*** | (2006.01) |
| *E04B 1/38* | (2006.01) |

(52) U.S. Cl.
CPC ..... *E04F 13/0816* (2013.01); *E04B 1/40* (2013.01); *E04F 13/0807* (2013.01); *E04B 2001/405* (2013.01)

(58) Field of Classification Search
CPC ..... E04F 13/0816; E04F 13/0814; E04F 13/083; E04F 13/24; E04F 13/081; F16B 5/0685; E06B 1/34
See application file for complete search history.

(56) References Cited

U.S. PATENT DOCUMENTS

| | | | | |
|---|---|---|---|---|
| 2,947,093 | A | | 8/1960 | Masters |
| 3,085,301 | A | | 4/1963 | Nuorivaara |
| 3,173,178 | A | | 3/1965 | Kumburis |
| 3,412,515 | A | | 11/1968 | Finon |
| 3,531,332 | A | | 9/1970 | Scott |
| 3,621,635 | A | | 11/1971 | De Lange |
| 3,803,789 | A | | 4/1974 | Gibson |
| 4,452,029 | A | | 6/1984 | Sukolics |
| 4,457,249 | A | | 7/1984 | Disen |
| 4,483,122 | A | | 11/1984 | Crandell |
| 4,553,366 | A | * | 11/1985 | Guerin ..... E04F 13/0803 52/506.08 |
| 4,625,481 | A | | 12/1986 | Crandell |
| 4,685,263 | A | | 8/1987 | Ting |
| 4,765,111 | A | | 8/1988 | Osawa |
| 4,783,941 | A | | 11/1988 | Loper et al. |
| 4,829,740 | A | | 5/1989 | Hutchison |
| 4,866,896 | A | | 9/1989 | Shreiner et al. |
| 4,928,467 | A | * | 5/1990 | Hintsa ..... E04F 19/06 52/510 |
| 5,069,014 | A | | 12/1991 | Kubbutat |
| 5,107,651 | A | | 4/1992 | Menchetti et al. |
| 5,155,958 | A | | 10/1992 | Huff |
| 5,220,763 | A | | 6/1993 | Armitage |
| 5,301,484 | A | | 4/1994 | Jansson |

(Continued)

FOREIGN PATENT DOCUMENTS

| | | |
|---|---|---|
| DE | 19828480 | 12/1999 |
| EP | 0659953 | 6/1995 |
| NL | 8701061 | 12/1988 |

OTHER PUBLICATIONS www.ktron.com/Industries; "Your One Source for Feeding, Pneumatic Conveying Systems Engineering Solutions"; 6 pages.

*Primary Examiner* — Brian Mattei
*Assistant Examiner* — Gisele Ford
(74) *Attorney, Agent, or Firm* — Stetina Brunda Garred & Brucker

(57) ABSTRACT

A system for mounting a plurality of wall panels is disclosed which incorporates a plurality of horizontal wall runners that have a plurality of holes along the length thereof in order to urge rainwater downward and onto the ground and also to dry out any water or moisture that may remain therebetween. The holes are formed at the lowest most portion of the trough in order to further urge the rainwater downward.

6 Claims, 32 Drawing Sheets

(56) References Cited

U.S. PATENT DOCUMENTS 5,398,473 A 3/1995 Chan
5,417,020 A 5/1995 Dobija
5,555,689 A 9/1996 Gilmore
5,590,502 A 1/1997 Wendt
5,598,667 A 2/1997 Dykes
5,661,937 A 9/1997 Doppler et al.
5,694,727 A 12/1997 Dobija
5,829,216 A 11/1998 Newcomb et al.
5,918,437 A 7/1999 Dobija
5,941,040 A 8/1999 McAnallen et al.
5,979,124 A 11/1999 Branan
6,035,598 A 3/2000 Sukolics et al.
6,170,214 B1 1/2001 Treister et al.
6,202,377 B1 * 3/2001 Krieger ..... E04F 13/0812 52/489.1
6,226,947 B1 * 5/2001 Bado ..... E04F 13/0805 52/235
6,308,486 B1 10/2001 Medland
6,374,561 B1 * 4/2002 Ishiko ..... E04F 13/0814 52/366
6,427,408 B1 8/2002 Krieger
6,484,465 B2 11/2002 Higgins
6,510,635 B1 1/2003 Rudolph et al.
6,591,575 B2 7/2003 Benedettini
6,631,589 B1 10/2003 Friedman
6,748,709 B1 6/2004 Sherman et al.
7,007,433 B2 * 3/2006 Boyer ..... E04C 2/292 52/309.9
7,562,504 B2 7/2009 Herbst et al.
7,621,084 B2 11/2009 Bilge
7,810,289 B2 10/2010 Montgomery
7,937,902 B1 5/2011 Smith et al.
8,033,066 B2 10/2011 Griffiths
8,127,507 B1 3/2012 Bilge
8,166,716 B2 5/2012 Macdonald et al.
D662,805 S * 7/2012 Macdonald ..... D8/373
8,240,099 B2 8/2012 Hummel, III
8,347,577 B2 1/2013 Aboukhalil
8,365,481 B2 * 2/2013 Scully ..... E04F 13/0805 52/235
8,839,582 B2 9/2014 Aboukhalil
9,080,331 B2 7/2015 Aboukhalil
2004/0139676 A1 7/2004 Knauseder
2006/0070329 A1 4/2006 Schiltz
2006/0080939 A1 4/2006 Bledsoe et al.
2007/0022682 A1 2/2007 Morgenegg et al.
2007/0119105 A1 5/2007 Macdonald et al.
2008/0066407 A1 * 3/2008 Son ..... E04F 13/0816 52/364
2009/0019795 A1 * 1/2009 Szacsvay ..... E04D 1/20 52/173.3
2009/0031652 A1 * 2/2009 Ortega Gatalan .... E04F 13/081 52/235
2009/0241444 A1 * 10/2009 Griffiths ..... E04F 13/0889 52/235
2009/0313928 A1 12/2009 Montgomery
2009/0313932 A1 * 12/2009 Montgomery ..... E04F 13/081 52/408
2009/0313935 A1 12/2009 Montgomery
2010/0251647 A1 10/2010 Enns
2010/0263314 A1 10/2010 Macdonald et al.
2011/0047916 A1 * 3/2011 Muller ..... E04F 13/144 52/477
2012/0017530 A1 1/2012 Hummel, III
2012/0302573 A1 11/2012 Jackson et al.
2012/0304572 A1 * 12/2012 Aboukhalil ..... E04F 13/0733 52/489.1
2012/0304573 A1 * 12/2012 Aboukhalil ..... E04F 13/0816 52/506.05
2012/0317909 A1 * 12/2012 MacKenzie ..... E04F 13/0803 52/288.1
2013/0091800 A1 4/2013 Aboukhalil
2013/0205698 A1 * 8/2013 Todd ..... E04F 13/0805 52/302.1
2013/0312352 A1 * 11/2013 Gale ..... E04F 13/24 52/483.1
2014/0150614 A1 * 6/2014 Aboukhalil ..... E04F 13/007 83/39

* cited by examiner

EXTERIOR WALL PANNELING SYSTEM

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates to a system for mounting a plurality of wall panels to an exterior surface of a wall.

Wall panels are currently mounted to interior surfaces of a wall and have certain difficulties that must be overcome in order to properly mount the wall panels to the interior surfaces of the wall. The panels may provide a unique design in order to change the ambience of the interior space of the building. Wall panels are also being applied to exterior surfaces of a building but external mounting of panels externally encounter other difficulties not related to mounting wall panels to interior surfaces of the wall.

Accordingly, there is a need in the art for an improved system for mounting wall panels to exterior surfaces of a building.

BRIEF SUMMARY

A system for mounting a plurality of wall panels to an exterior surface of a wall is disclosed herein. The system has a plurality of horizontal wall runners that space the plurality of wall panels away from the exterior surface of the wall. Optionally, vertical wall runners may also be used to space the plurality of wall panels away from the exterior surface of the wall. Rainwater that may seep between the wall panels and the wall is drained out therefrom through a series of holes that are formed in the horizontal wall runners to urge the rainwater by gravity downward and onto the ground. Moreover, the holes are located at the bottom of a trough of the horizontal wall runner in order to further urge the rainwater downward to the ground. The vertical wall runners, if used, also have a plurality of holes which in conjunction with the plurality of holes formed in the horizontal wall runners provide both vertical and lateral airflow behind the panels in order to dry out any water or moisture that may remain between the wall and the wall panels in order to equalize the moisture from therebetween and the ambient moisture. If no vertical wall runners are used, then lateral air flow behind the panels is increased compared to when vertical wall runners are used.

More particularly, an exterior wall panel system which mitigates pooling of water and mold is disclosed. The system may comprise a plurality of panels and horizontal wall runners. The plurality of panels may have a thickness between about ⅛ inch to about 1½ inches. The plurality of panels may be disposed adjacent to each other in a single plane. The plurality of horizontal wall runners may be attached to a wall and the plurality of panels. Each of the horizontal wall runners may have a base, a first panel attachment member and a spacer that attaches the panel attachment member to the base.

The spacer may have a funnel-shaped cross sectional configuration along at least a portion of a length of the horizontal wall runner and a plurality of holes along at least the portion of the length of the horizontal wall runner at a trough of the funnel-shaped cross sectional configuration for directing water introduced between the plurality of panels and the wall below the horizontal wall runner. The plurality of panels may have a second panel attachment member that is attachable to the first panel attachment member for securing the plurality of panels to the wall.

Each of the horizontal wall runners may have an upper first panel attachment member and an upper spacer and a lower first panel attachment member and a lower spacer wherein each of the upper and lower spacers have the funnel-shaped cross sectional configuration and the plurality of holes. The first panel attachment member may be an upwardly directed prong which may be removably attachable to the second panel attachment member of the panel. The second panel attachment member may be a clip attached to a back side of the panel wherein the first attachment member may be held between the clip and the panel.

The plurality of panels may be fabricated from phenolic. The plurality of horizontal wall runners may be fabricated from aluminum.

In another aspect, a variable distance mounting device for mounting horizontal runners to a wall is disclosed. The variable distance mounting device may also be used to mount vertical runners to the wall as well. However, the vertical runners are optional, and not required. The device may comprise a base and a sliding component. The base may be attached to a stud of the wall. The base may have first and second plates spaced apart from each other by a first distance. The first and second plates may be positioned parallel to each other. Each of the first and second plates may have an elongated slot perpendicular to a back surface of the base. The elongated slots of the first and second plates may be parallel to each other. The sliding component may have a thickness equal to about the first distance so that the sliding component can be traversed between the first and second plates in a direction of the parallel elongated slots of the first and second plates. The sliding component may have through holes aligned to the elongated slots and capable of receiving fasteners in order to fix a position of the sliding component between the first and second plates. The sliding component may have a mounting pad to mount the horizontal or vertical wall runner.

Each of the first and second plates may have two elongated slots which are sized and configured to receive a fastener. The base and the sliding component may be fabricated from aluminum with an aluminum extrusion process. The mounting pad may comprise two outwardly extending wings.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
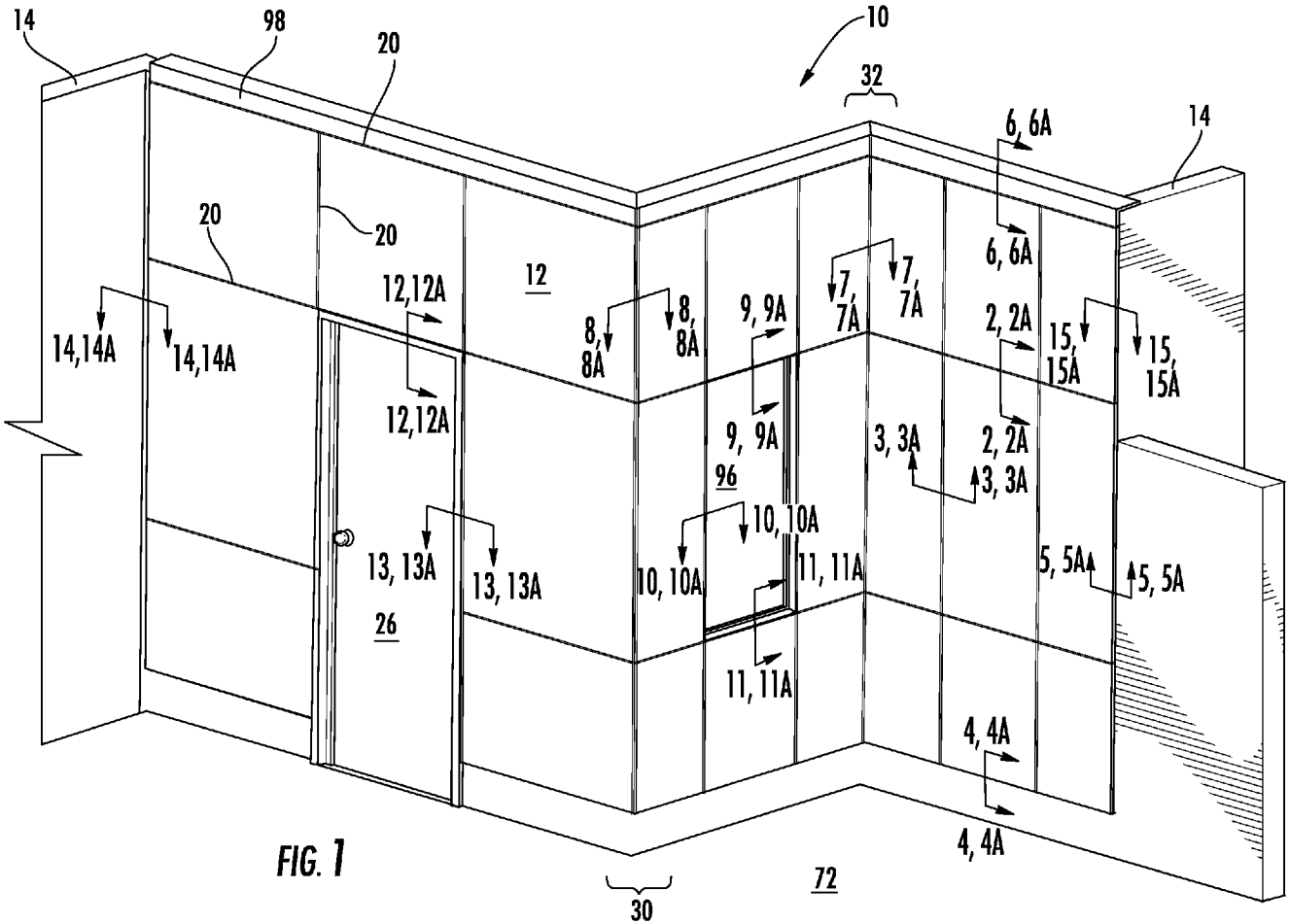
FIG. 1 illustrates a perspective view of a wall panel system mounted to a wall.

Referring now to the drawings, a wall panel system 10 is disclosed wherein the wall panel system 10 comprises a plurality of panels 12 that are attachable to a wall 14. The plurality of panels 12 may be attached to an exterior wall 14 which is exposed to the environmental elements such as wind, rain, sun, debris, as shown in FIG. 1. However, the wall panel system 10 may be used to mount the plurality of panels 12 to an interior wall 14. The wall panel system 10 forms a gap 16 (see FIG. 2) between the wall panel 12 and the wall 14. Rainwater may seep between the panel 12 and the wall 14 from the top 18 or through horizontal and vertical recess reveals 20 between adjacent panels 12. The wall panel system 10 allows the water to flow downward in the direction of arrow 22 so that the water flows out of the bottom 24. Additionally, the water can flow horizontally if needed to eventually escape to the bottom 24. Additionally, the wall panel system 10 provides for a sufficient degree of vertical airflow behind adjacent upper and lower panels 12 as well as horizontal airflow behind adjacent left and right panels 12. In this manner, water that seeps between the wall 14 in the panel 12 is flushed out to the bottom 24 and any water that remains is dried out over a period of time in order to prevent or mitigate the formation of mold in the gap 16.

Figure 2:
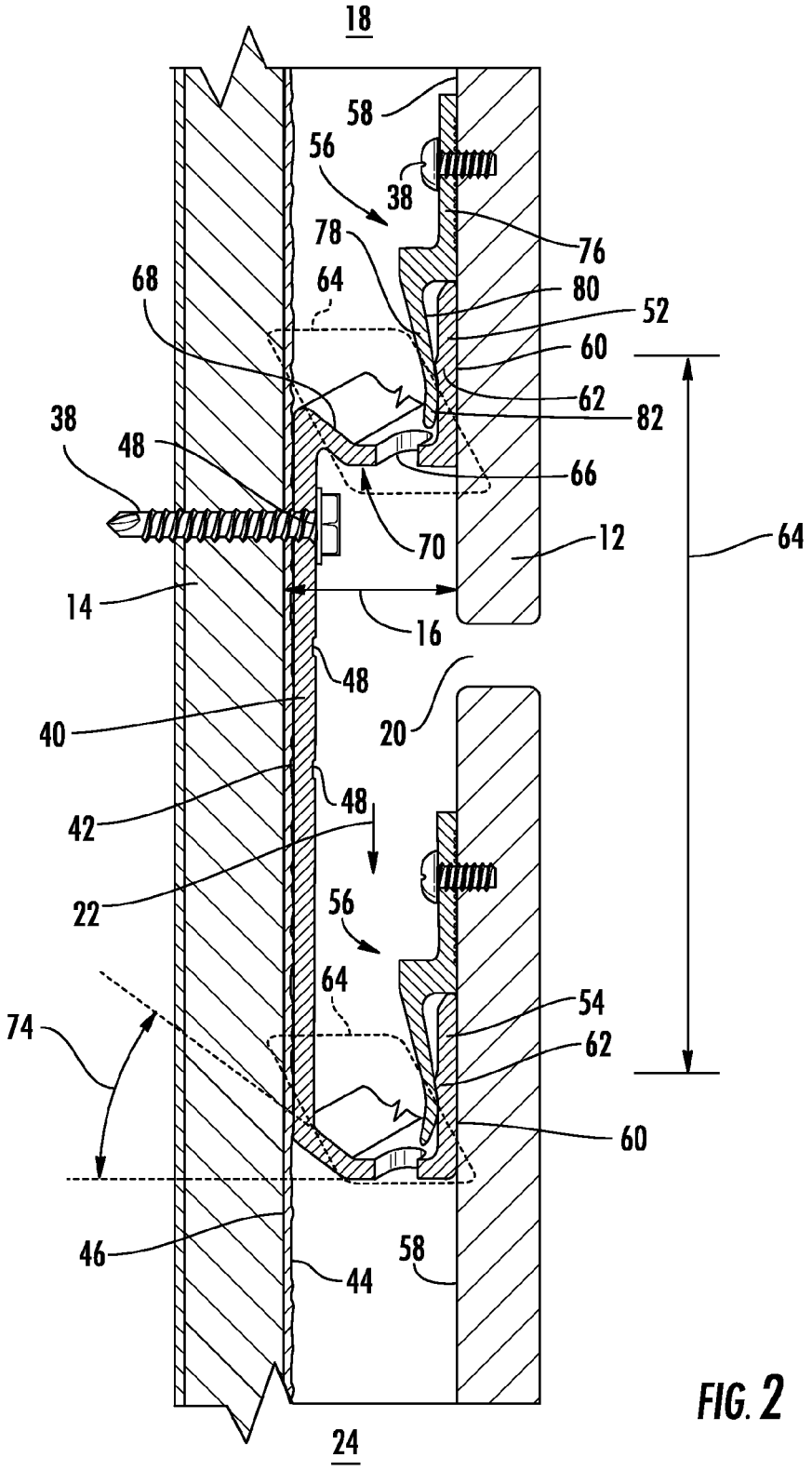
FIG. 2 is a first cross-sectional view of a first embodiment of the wall panel system shown in FIG. 1.
Figure 2A:
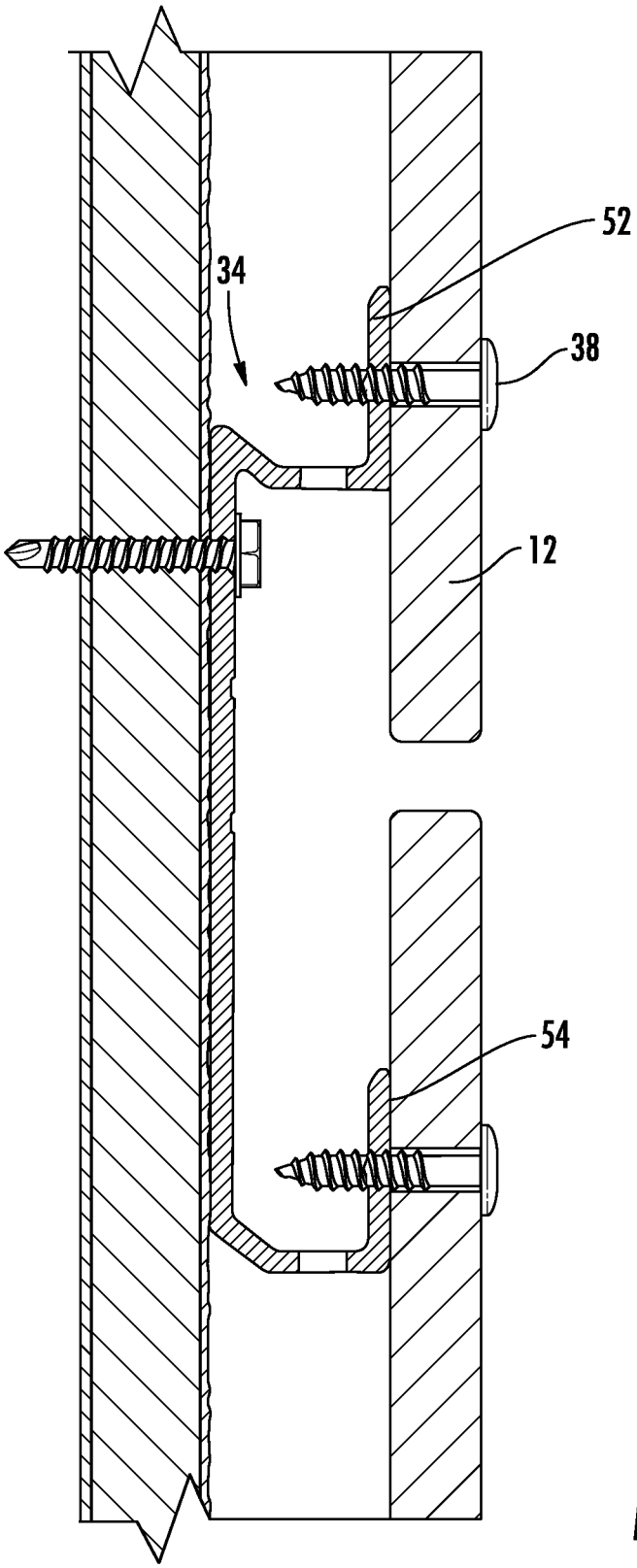
FIG. 2A is a first cross-sectional view of a second embodiment of the wall panel system shown in FIG. 1.

Referring now to FIG. 1, a plurality of wall panels 12 may be secured to an exterior wall 14 and circumscribed a door 26, and a window 28. The wall panel system 10 also provides for mounting the panels 12 to an outside corner 30 or an inside corner 32. The wall panel system 10 may have a plurality of horizontal wall runners 34 that are attached to the wall 14. Optionally, the wall panel system 10 may also utilize vertical wall runners 36 which are also attached to the wall 14. Referring now to FIG. 2, a horizontal wall runner 34 is shown being attached to the wall 14 with screws 38. The horizontal wall runner 34 has a base 40 defining a back surface 42. The back surface 42 contacts the wall 14, and more specifically indirectly contacts the wall 14 since the vapor barrier 44 is placed on the outer surface 46 of the wall 14. The base 40 of the horizontal wall runner 34 may have one or more grooves 48 that extend along the length of the horizontal wall runner 34*a*. The grooves 48 aid in the location and screwing in of screw 38 through the base 40 and into the wall 14. The horizontal wall runner 34 shown in FIG. 2 has upper and lower prongs 52, 54.

The upper and lower prongs 52, 54 are oriented upwardly so that clips 56 secured to the back surfaces 58 of the panels 12 can be clipped over the upper and lower prongs 52, 54. The clips 56 receive the upper and lower prongs 52, 54 until the upper distal ends of the upper and lower prongs 52, 54 rest on the inner surfaces of the clips 56. The upper and lower prongs 52, 54 may have front surfaces 60 that contact the back surfaces 58 of the panels 12. The front surfaces 60 of the upper and lower prongs 52, 54 may be parallel with the back surface 42 of the base 40. As such, when the panels 12 are mounted to the horizontal wall runner 34, the panels 12 are positioned parallel to the outer surface 46 of the wall 14. The back surface 42 of the base 40 and the front surface 60 of the upper and lower prongs 52, 54 are generally flat as well to provide more convenient mounting to the wall 14 and the panels 12. The upper and lower prongs 52, 54 may also have protruding nubs 62 that extends away from the front surfaces 60 of the upper and lower prongs 52, 54. The protruding nub may extend out about 0.018 inches. The protruding nubs 62 of the upper and lower prongs 52, 54 mate with the clips 56 and the clips 56 extend over the protruding nubs 62 in order to provide pullout resistance to the panels 12. In order to pull out the panels 12, the user needs to lift the panels 12 with sufficient force in order to deflect the clips 56 over the protruding nubs 62.

The horizontal wall runner 34, as discussed above, has upper and lower prongs 52, 54. These prongs 52, 54 are separated from each other by distance 64. The distance 64 is sufficient in order to hide the screw 38 that secures the base 40 of the wall runner 34 to the wall 14 behind the upper panel 12 and also to hide the clip 56 attached to the lower panel 12. The screw 38 attached to the base 42 and the wall 14 is shown as being hidden behind the upper panel 12. However, it is also contemplated that the screw 38 may be inserted through the base 40 of the wall runner 34 at a lower position in order to hide the screw 38 behind the lower panel 12. In this regard, the screw 38 may be inserted into the other grooves 48 on the base 40 of the wall runner 34.

Each of the upper and lower prongs 52, 54 may be secured to the base 40 with respective upper and lower spacers 64. Each of the upper and lower spacers 64 may have a funnel shaped cross-sectional configuration and a plurality of holes 66 extending along a length of the horizontal runner 34. In particular, the funnel shaped cross-sectional configuration includes a downwardly sloping surface 68 that terminates at a trough 70. Water that drips on the vapor barrier 44 at the outer surface 46 of the wall 14 drips downward on the downwardly sloping surface 68 and into the hole 66 in order to flow the water downward and ultimately onto the ground 72 below. Preferably, the downwardly sloping surface is at a 28° angle 74 with respect to a horizontal plane. The angle 74 of the downwardly sloping surface may be increased or decreased depending on various factors up to 55° or as low as 10°.

The clips 56 are secured to the back surfaces 58 of the panels 12 by way of screws 38. The clips 56 have a foot 76 through which one or more screws 38 attach the clip 56 to the panel 12. The clips 56 may additionally have a downwardly extending prong 78 having an inner surface 80 that mates with the protruding nub 62 in order to provide pull out resistance when the panels 12 are being lifted upward for removal. This prevents inadvertent removal during earthquakes and also by vandals that might want to remove panels 12 from the wall 14 without authorization. The clips 56 also have a bent lip 82 that helps to insert the prongs 52, 54 between the downwardly extending prong 78 of the clip 56 and the panel 12. A distal end of the bent lip 82 may be about 3/16" gapped away from the bottom of the trough to allow for movement of the panel during natural movement of the ground or building. The bent lip 82 has an enlarged opening that the upwardly extending prongs 52, 54 can catch for inserting the prongs 52, 54 between the clip 56 and the panel 12. Additionally, the bent lip 82 also guides water that drips on the clip 56 into the holes 66 to further urge water downward to the ground 72.

Figure 3:
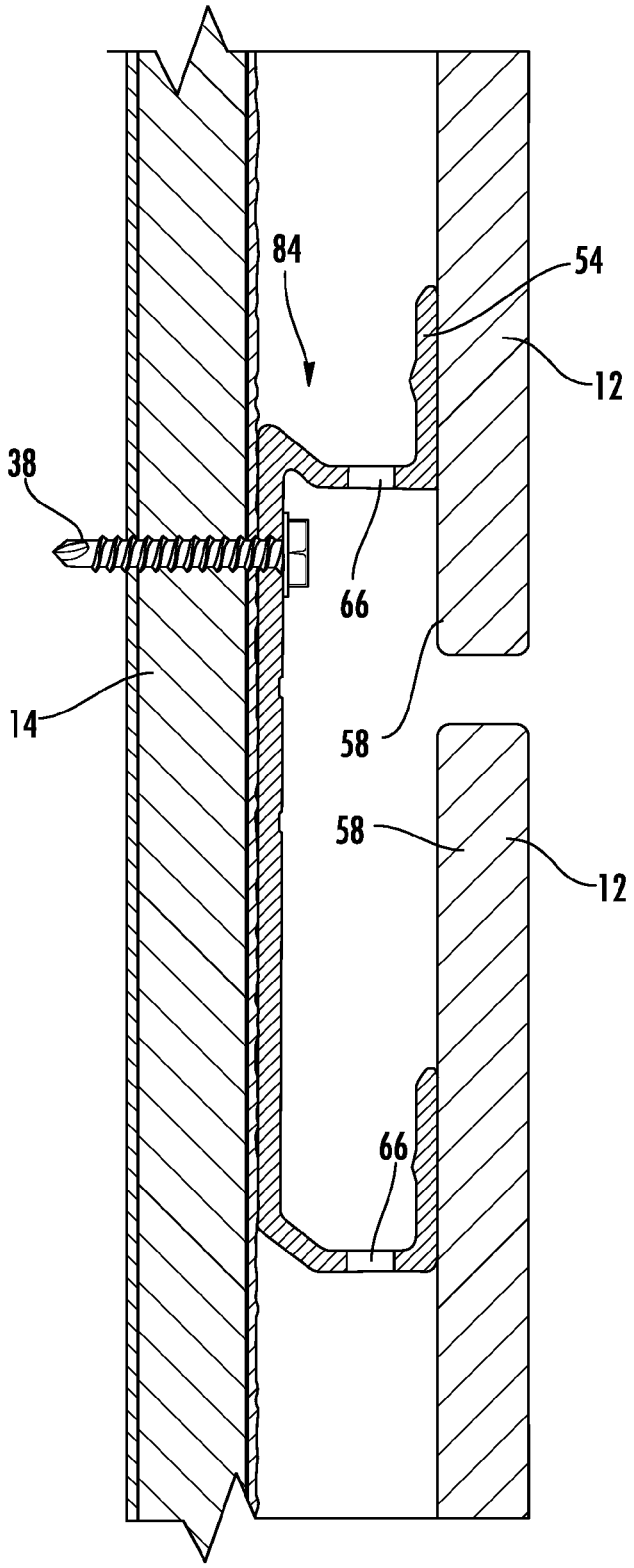
FIG. 3 is a second cross-sectional view of the first embodiment of the wall panel system shown in FIG. 1.
Figure 3A:
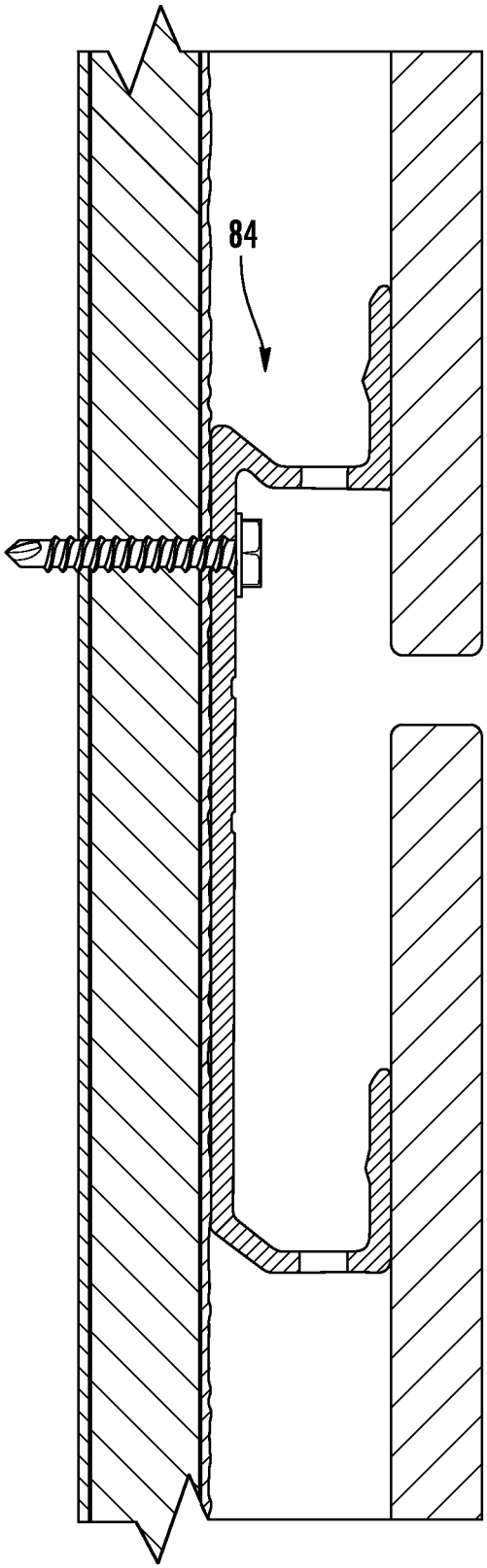
FIG. 3A is a second cross-sectional view of the second embodiment of the wall panel system shown in FIG. 1.

Referring now to FIG. 3, the horizontal wall runner 34 may also be utilized as a vertical wall runner 84 by reorienting the horizontal wall runner 34 is the vertical direction. The vertical wall runner 84 is optional, and not required. In this regard, if used, the vertical wall runner 84 is secured to the wall 14 by way of screw 38. However, the vertical wall runner 84 is not secured to the horizontally adjacent panels 12. Rather, the vertical wall runner 84 may be used to provide stability to the panels 12 in the event that the panels 12 are pushed closer to the wall 14. The upper and lower prongs 52, 54 merely contact the back surfaces 58 of the panels 12. Additionally, the vertical wall runner 84 provides airway passage horizontally behind adjacent left and right panels 12 through the plurality of holes 66 formed in the spacers 64 in order to dry out any water that may remain behind the panels 12.

Figure 4:
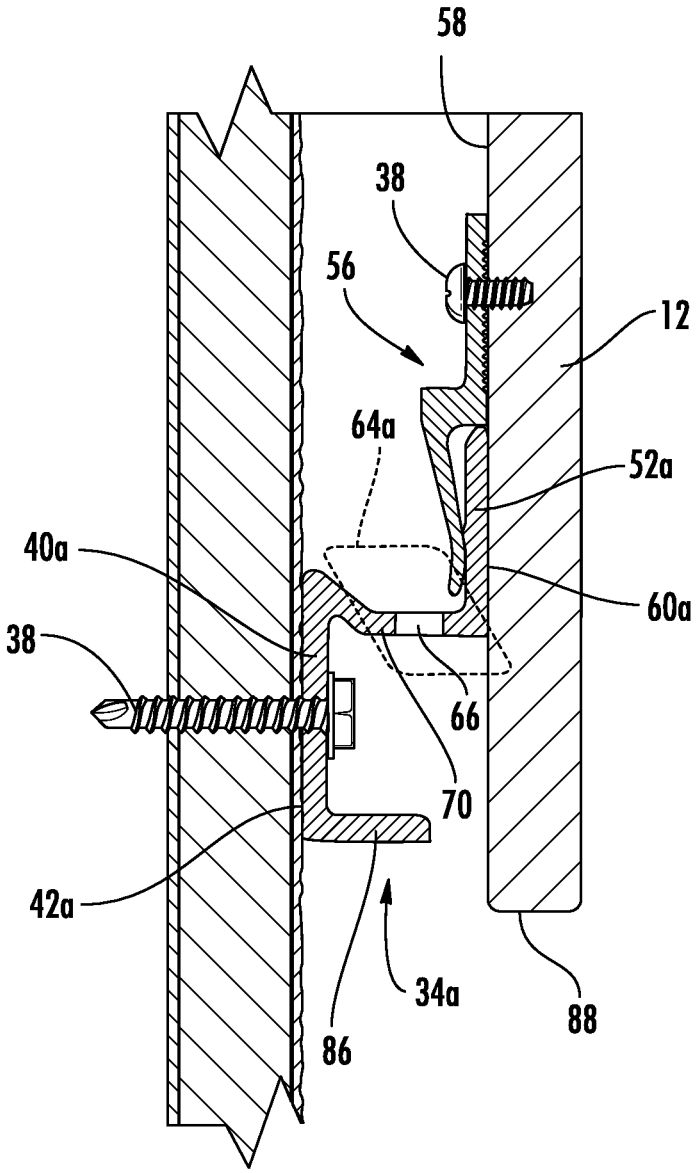
FIG. 4 is a third cross-sectional view of the first embodiment of the wall panel system shown in FIG. 1.
Figure 4A:
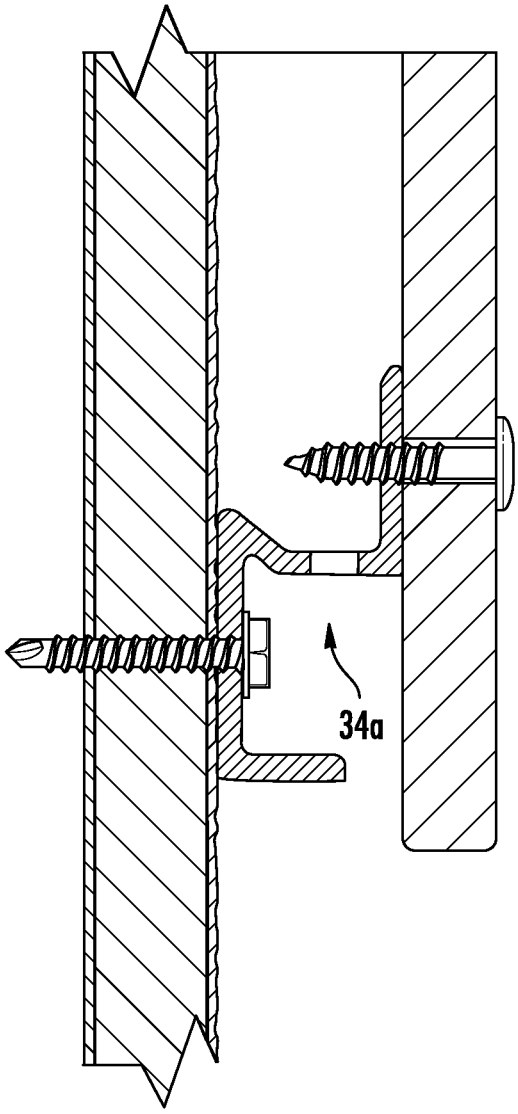
FIG. 4A is a third cross-sectional view of the first embodiment of the wall panel system shown in FIG. 1.

Referring now to FIG. 4, an alternate embodiment of the horizontal wall runner 34*a* is shown. The horizontal wall runner 34*a* has a single prong 52*a* that is spaced away from a base 40*a* by spacer 64*a*. The horizontal wall runner 34*a* incorporates a spacer 64*a* having a funnel-shaped cross-sectional configuration with a plurality of holes 66 that extend along a length of the spacer 64*a* at the trough 70 thereof. The horizontal wall runner 34*a* may also have a back surface 42*a* of the base 40*a* that is parallel to a front surface 60*a* of the prong 52*a*. The horizontal wall runner 34*a* may be identical to the horizontal wall runner 34 except that the horizontal wall runner 34*a* does not incorporate the bottom half of the horizontal wall runner 34. Moreover, the base 40*a* has a return member 86. Unlike the horizontal wall runner 34*a*, the horizontal wall runner 34*a* does not have a groove 48 that assists in locating the screw 38. However, it is contemplated that the groove 48 shown in reference to the horizontal wall runner 34 may be incorporated to the base 40 of the horizontal wall runner 34*a*. The clip 56 may be attached to the back surface 58 of the panel 12 with the screw 38. The clip 56 is positioned sufficiently high above the lower end 88 of the panel 12 in order to hide the horizontal wall runner 34*a* behind the panel 12 when viewed elevationally.

Figure 5:
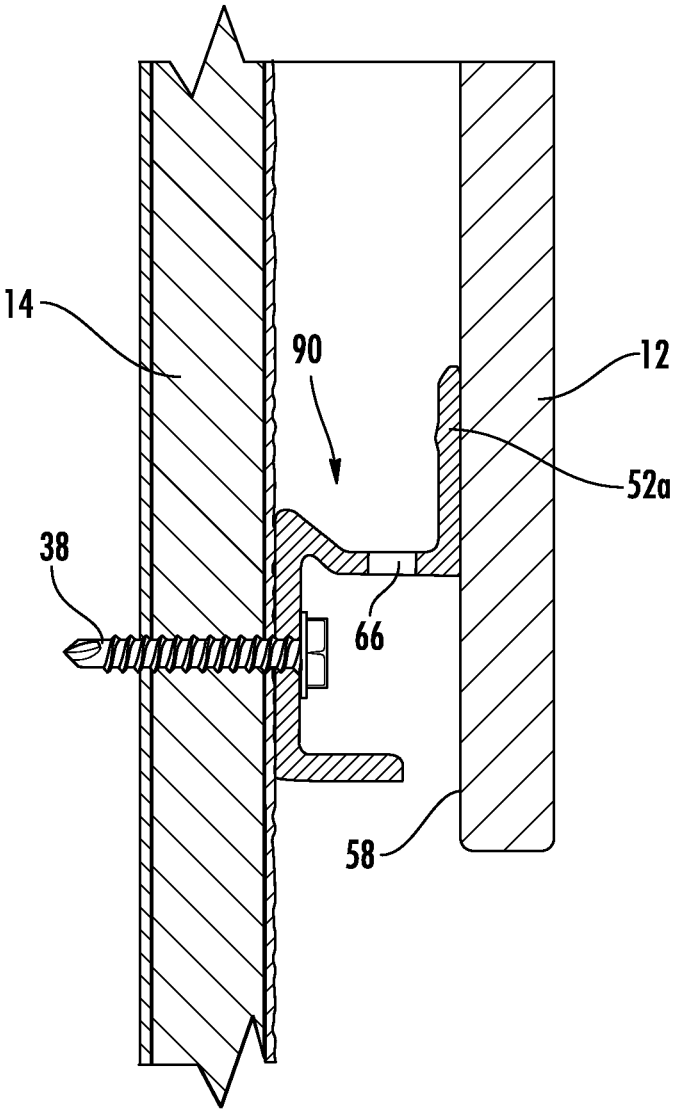
FIG. 5 is a fourth cross-sectional view of the first embodiment of the wall panel system shown in FIG. 1.
Figure 5A:
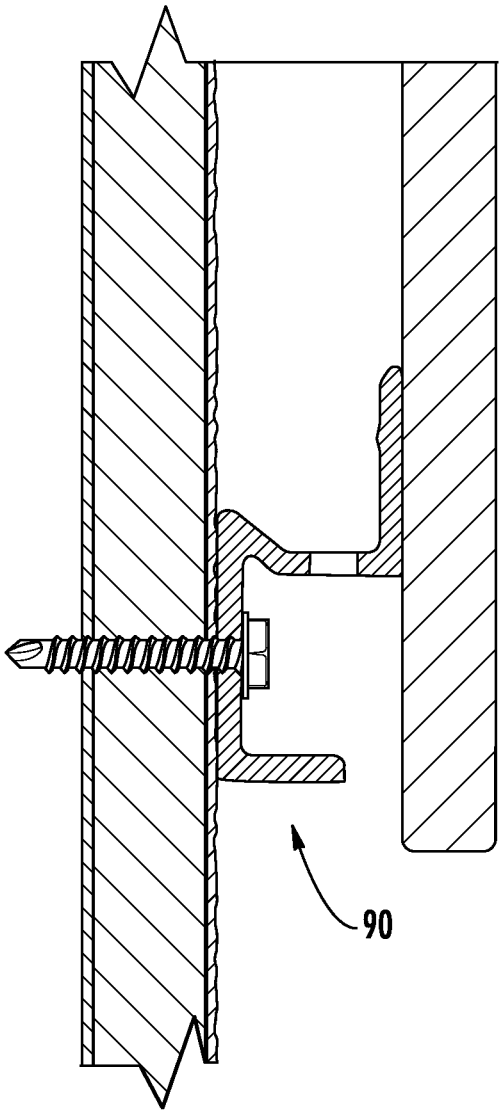
FIG. 5A is a fourth cross-sectional view of the first embodiment of the wall panel system shown in FIG. 1.

Referring now to FIG. 5, the horizontal wall runner 34*a* may also be used as a vertical wall runner 90*a* by orienting the horizontal wall runner 34*a* in the vertical direction. The vertical wall runner 90*a* is optional, and not required. In this regard, if used, the vertical wall runner 90*a* is secured to the wall 14 by way of screw 38. However, the vertical wall runner 90 is not secured to the panel 12. Rather, the vertical wall runner 90 merely provides stability to the panel 12 in the event that the panel 12 is pushed closer to the wall 14. The prong 52*a* merely contacts the back surface 58 of the panel 12. Additionally, the vertical wall runner 90 provides airway passage horizontally through the plurality of holes 66 formed in the spacers 64*a* in order to dry out any water that may remain behind the panel 12.

Figure 6:
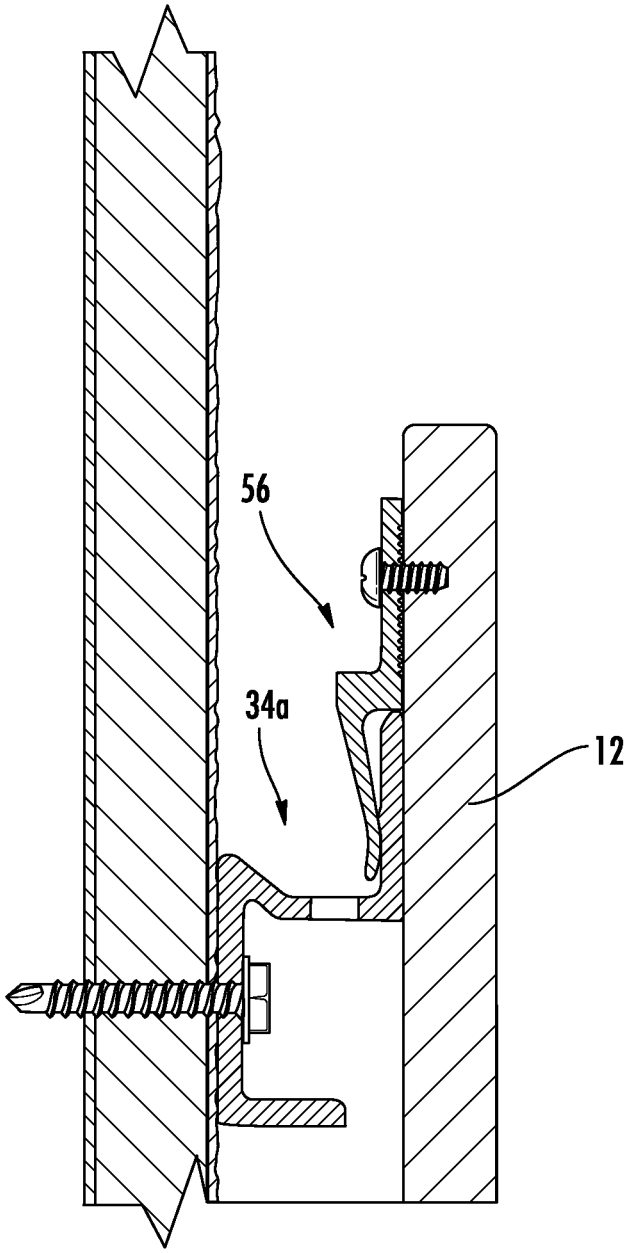
FIG. 6 is a fifth cross-sectional view of the first embodiment of the wall panel system shown in FIG. 1.
Figure 6A:
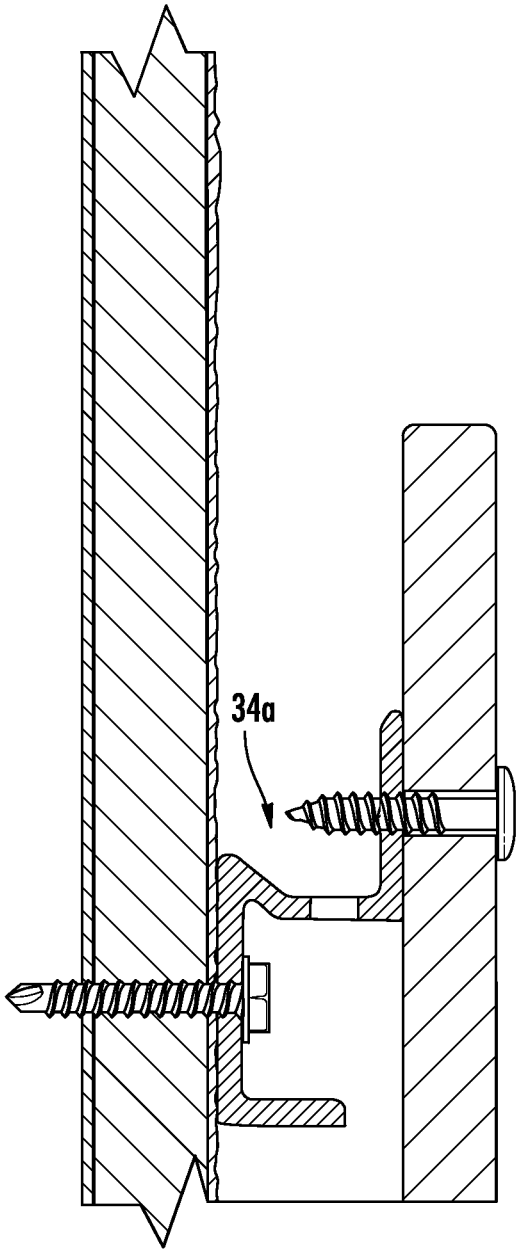
FIG. 6A is a fifth cross-sectional view of the first embodiment of the wall panel system shown in FIG. 1.
Figure 14:
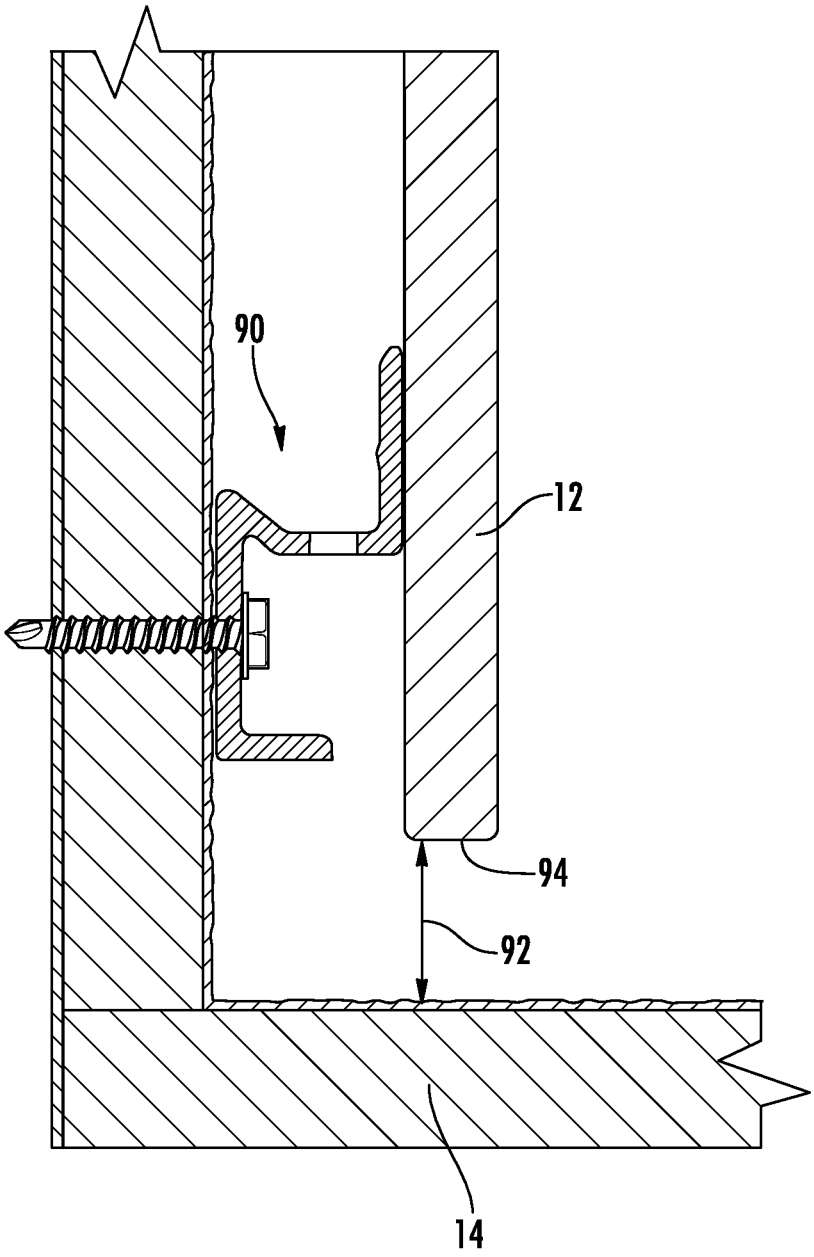
FIG. 14 is a thirteenth cross-sectional view of the first embodiment of the wall panel system shown in FIG. 1.
Figure 14A:
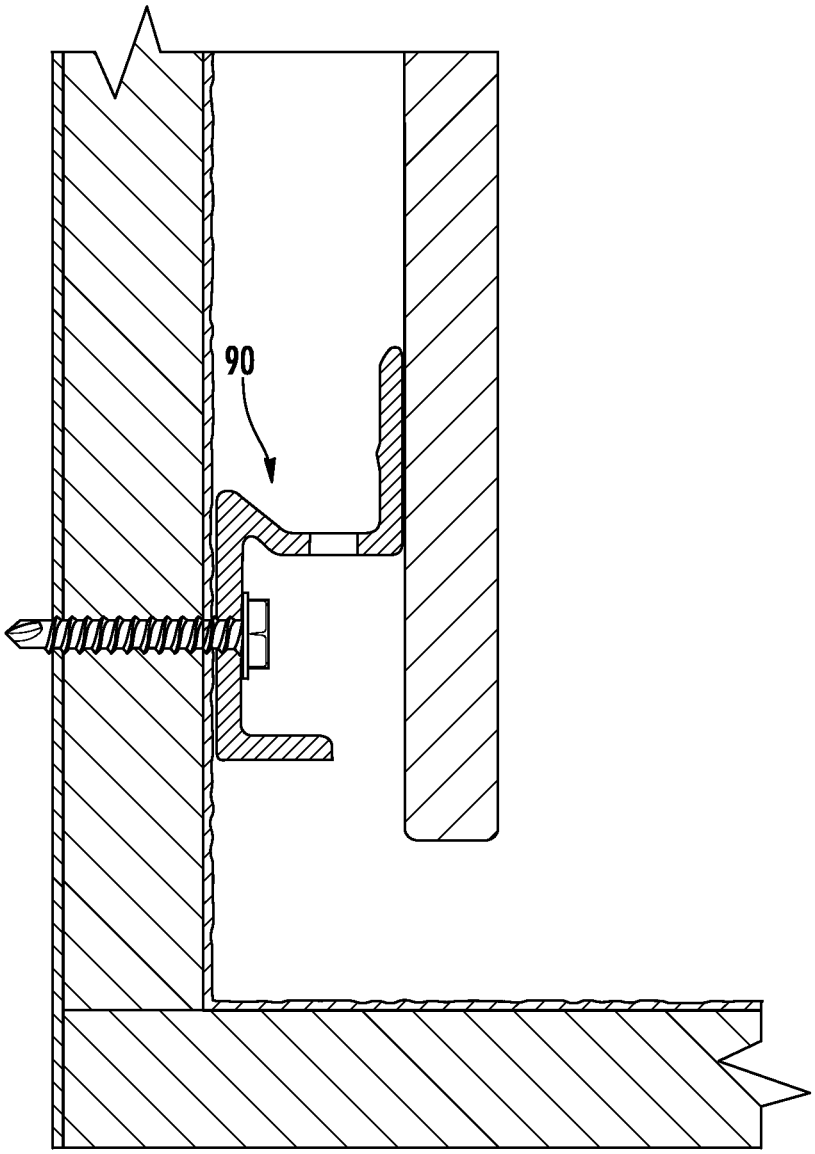
FIG. 14A is a thirteenth cross-sectional view of the first embodiment of the wall panel system shown in FIG. 1.
Figure 15:
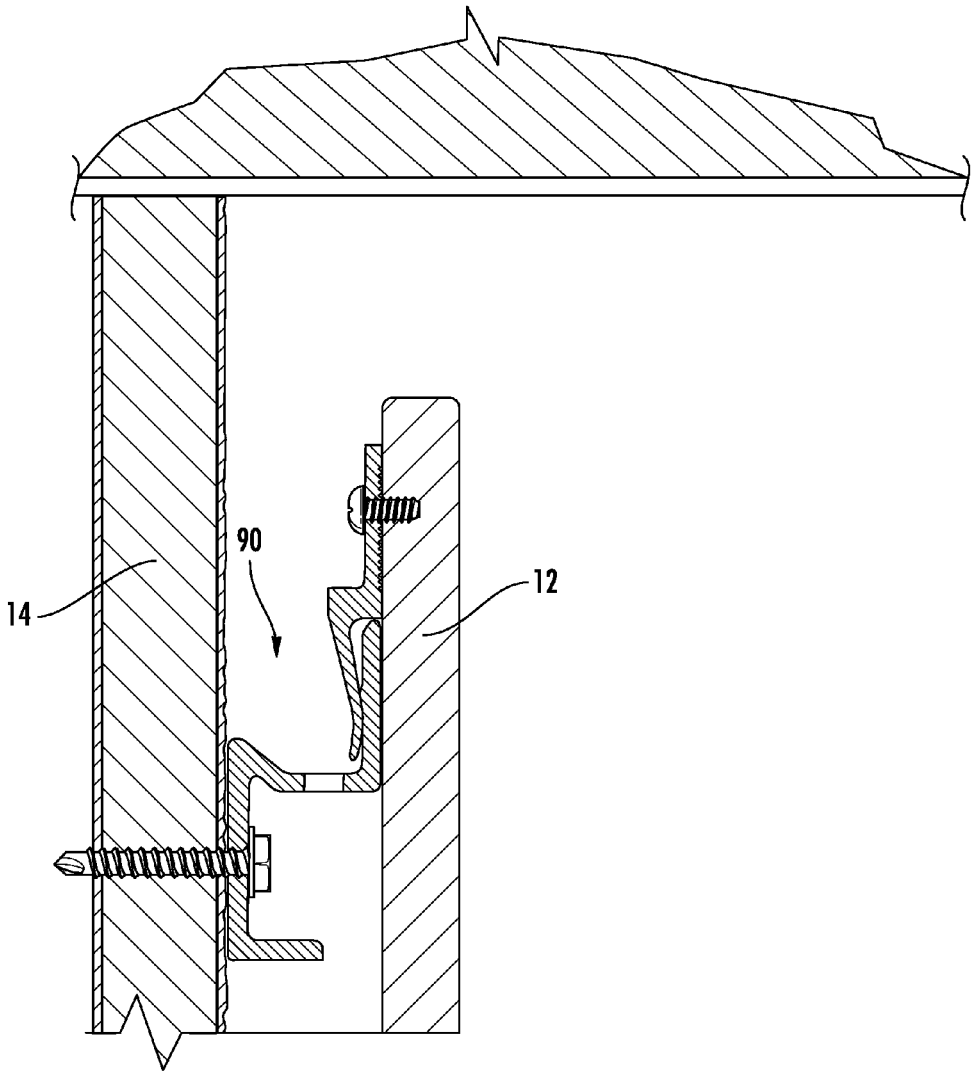
FIG. 15 is a fourteenth cross-sectional view of the first embodiment of the wall panel system shown in FIG. 1.
Figure 15A:
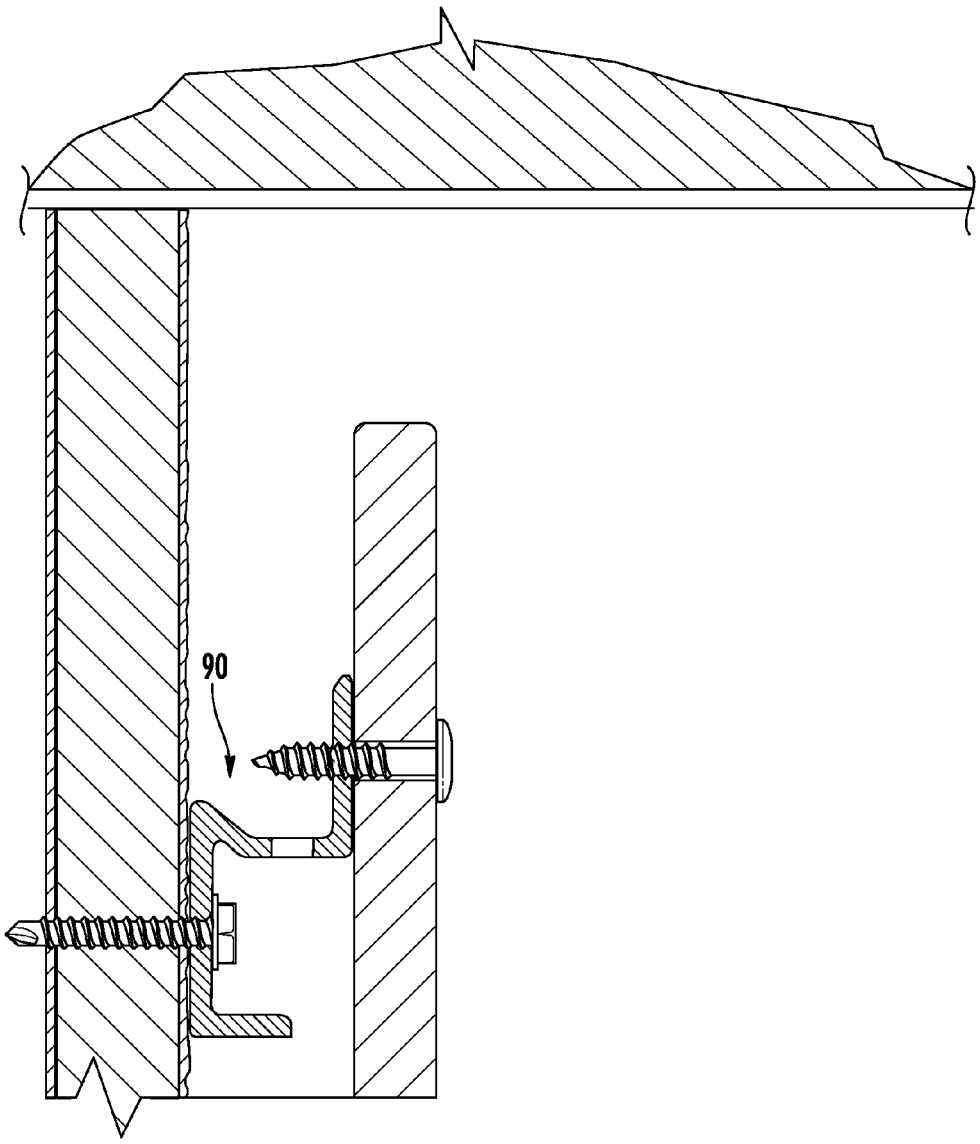
FIG. 15A is a fourteenth cross-sectional view of the first embodiment of the wall panel system shown in FIG. 1.

FIG. 4 illustrates the horizontal wall runner 34*a* and lower edge of the plurality of wall panels 12 mounted to the wall 14. FIG. 5 illustrates the vertical wall runner 90 at a right side edge of the panel 12. FIG. 6 illustrates the horizontal wall runner 34*a* at an upper edge of the plurality of wall panels 12 mounted to the wall 14. The horizontal wall 34*a* is sufficiently recessed down behind the panel 12 so that the clip 56 and the horizontal wall runner 34*a* is hidden behind the panel 12. FIG. 15 illustrates the vertical wall runner 84 at a right side edge of a panel 12 of an outside corner of the wall 14. FIG. 14 illustrates the vertical wall runner 84 at a left side edge of the panel 12 of an inside corner of the wall 14. The gap 92 between the exposed edge 94 and the wall 14 may be adjusted by cutting the panel 12 short and adjusting the position of the vertical wall runner 84 behind the panel 12. The vertical wall runners 90, 84 shown in FIGS. 5, 14 and 15 are optional and not required.

Figure 12:
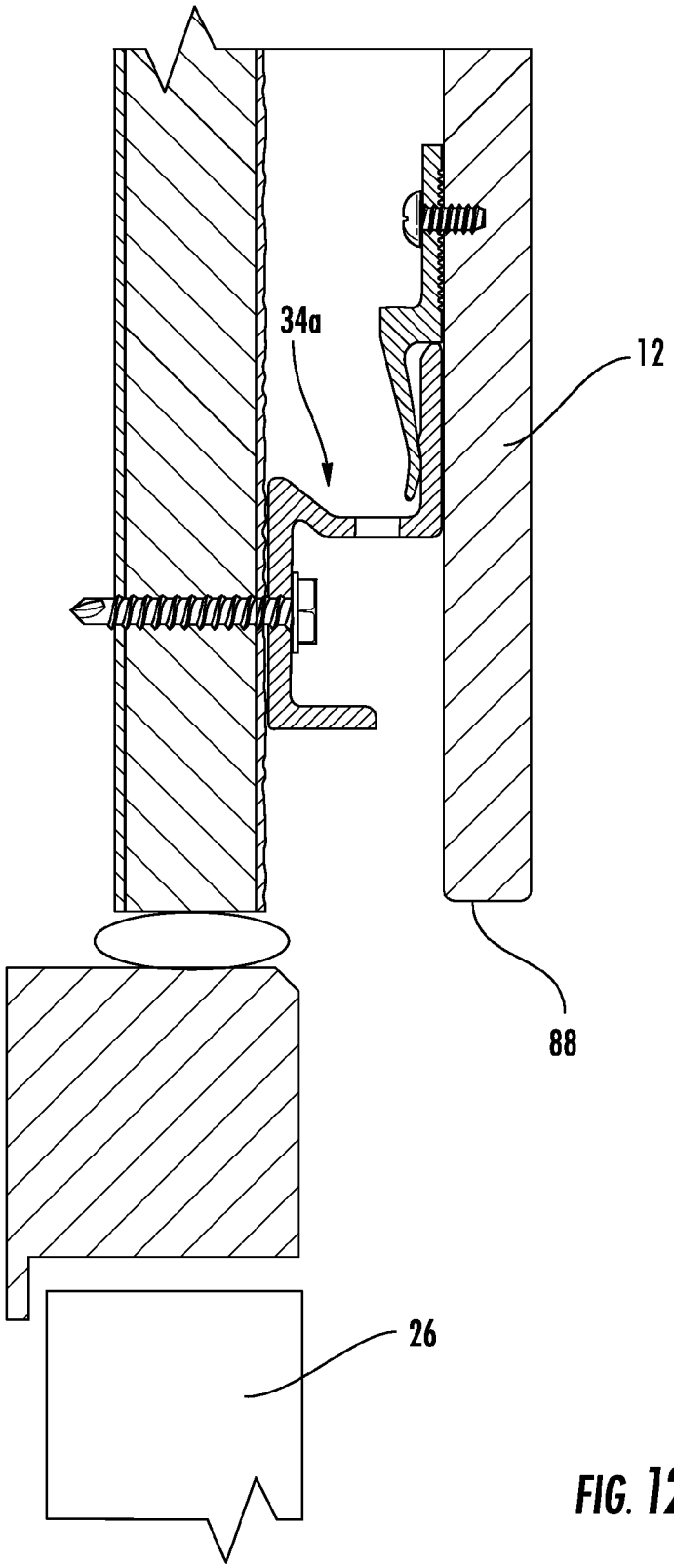
FIG. 12 is an eleventh cross-sectional view of the first embodiment of the wall panel system shown in FIG. 1.
Figure 12A:
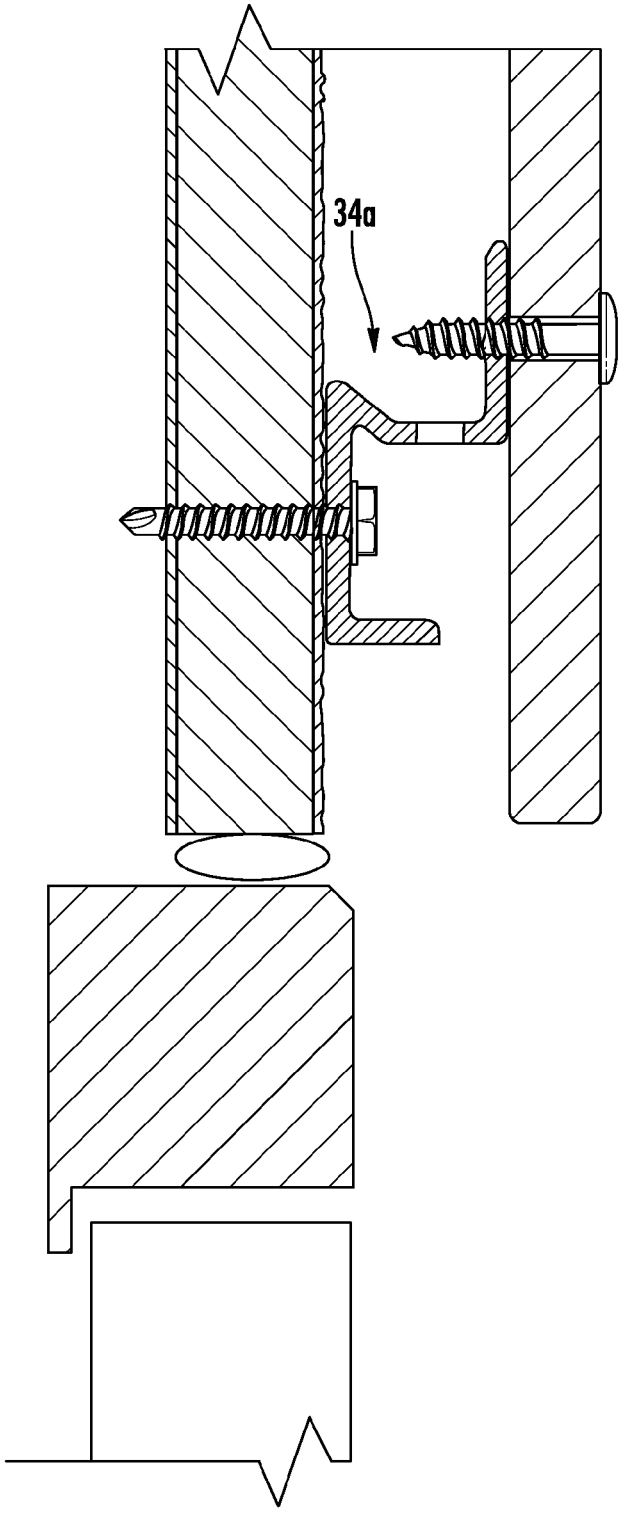
FIG. 12A is an eleventh cross-sectional view of the first embodiment of the wall panel system shown in FIG. 1.
Figure 13:
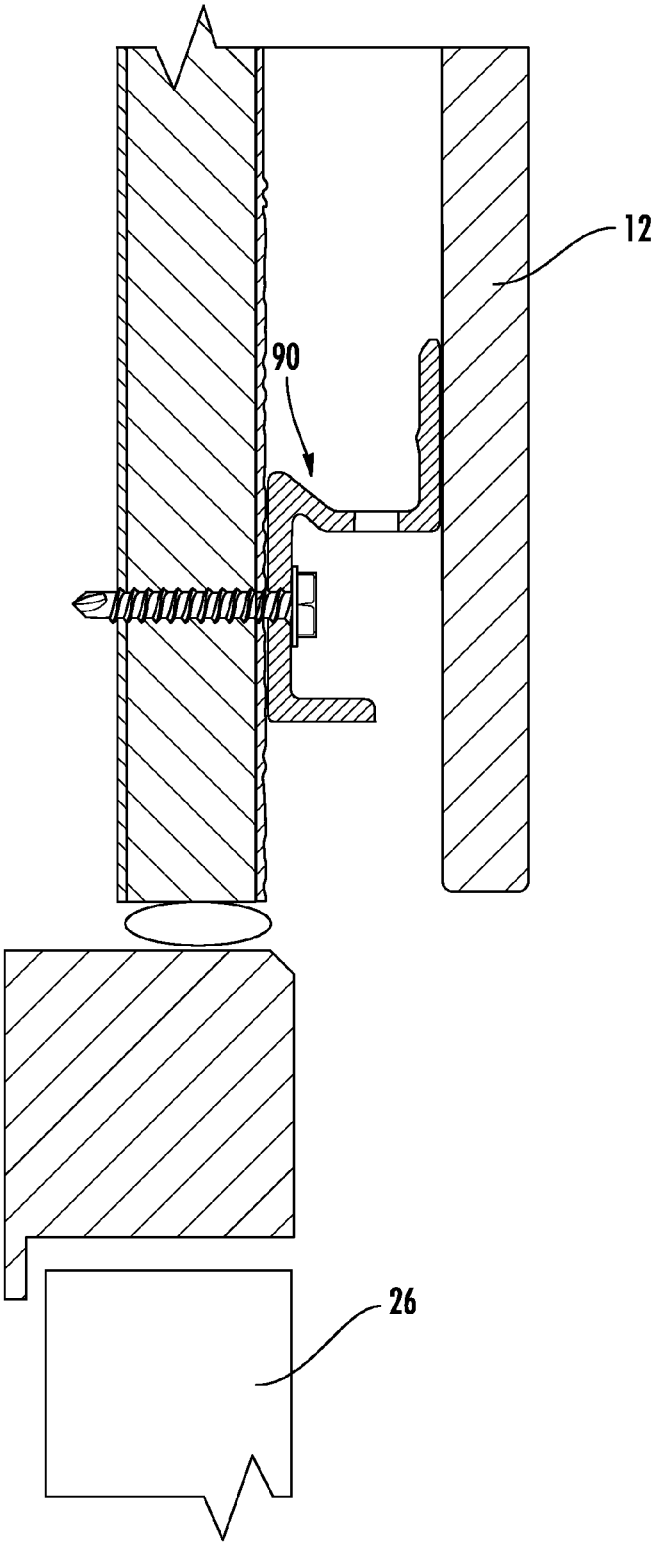
FIG. 13 is a twelfth cross-sectional view of the first embodiment of the wall panel system shown in FIG. 1.
Figure 13A:
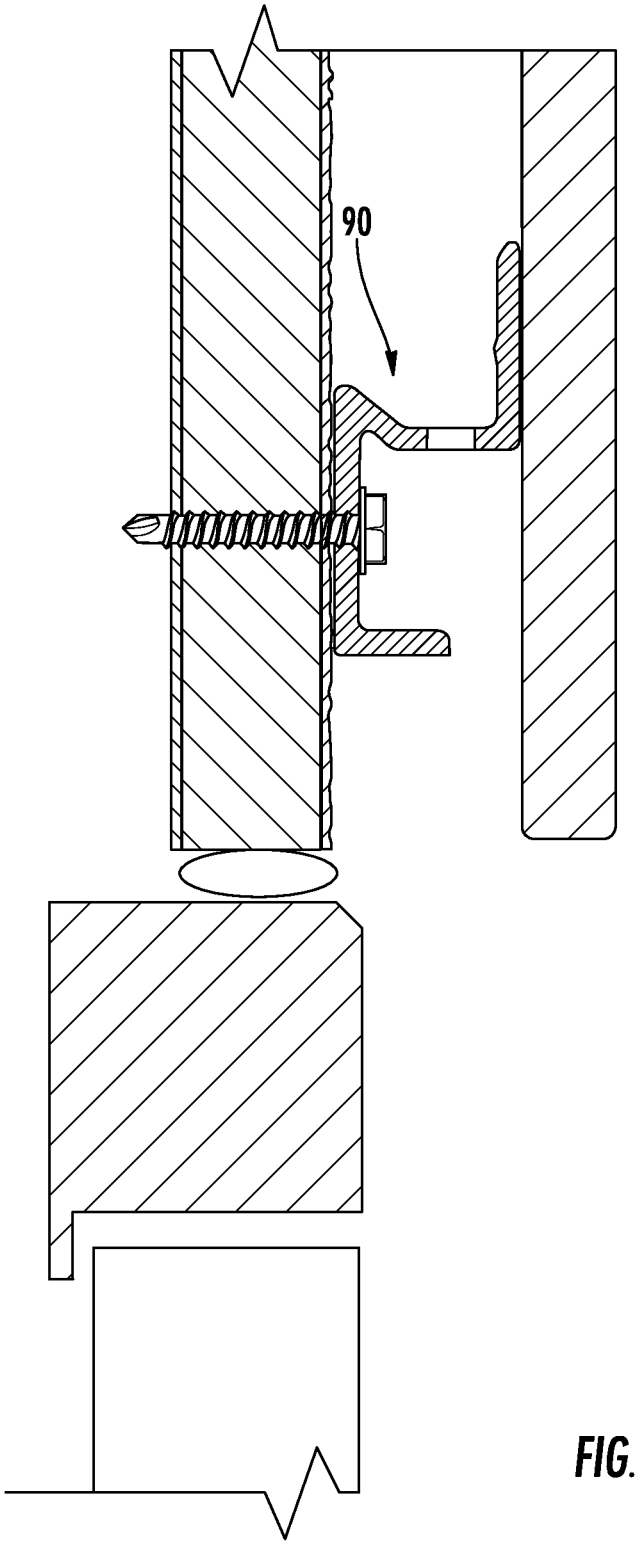
FIG. 13A is a twelfth cross-sectional view of the first embodiment of the wall panel system shown in FIG. 1.

The plurality of wall panels 12 may also be disposed circumferentially about the door 26 and a window 96. FIGS. 12 and 13 illustrate the horizontal wall runner 34*a* holding the panel 12 directly above the door 26 and allowing for the exposed edge 88. FIG. 13 illustrates a vertical wall runner 90 for providing stability to the panel 12 positioned laterally about the door 26. As indicated above, the vertical wall runner 90 shown in FIG. 13 is optional and not required.

Figure 7:
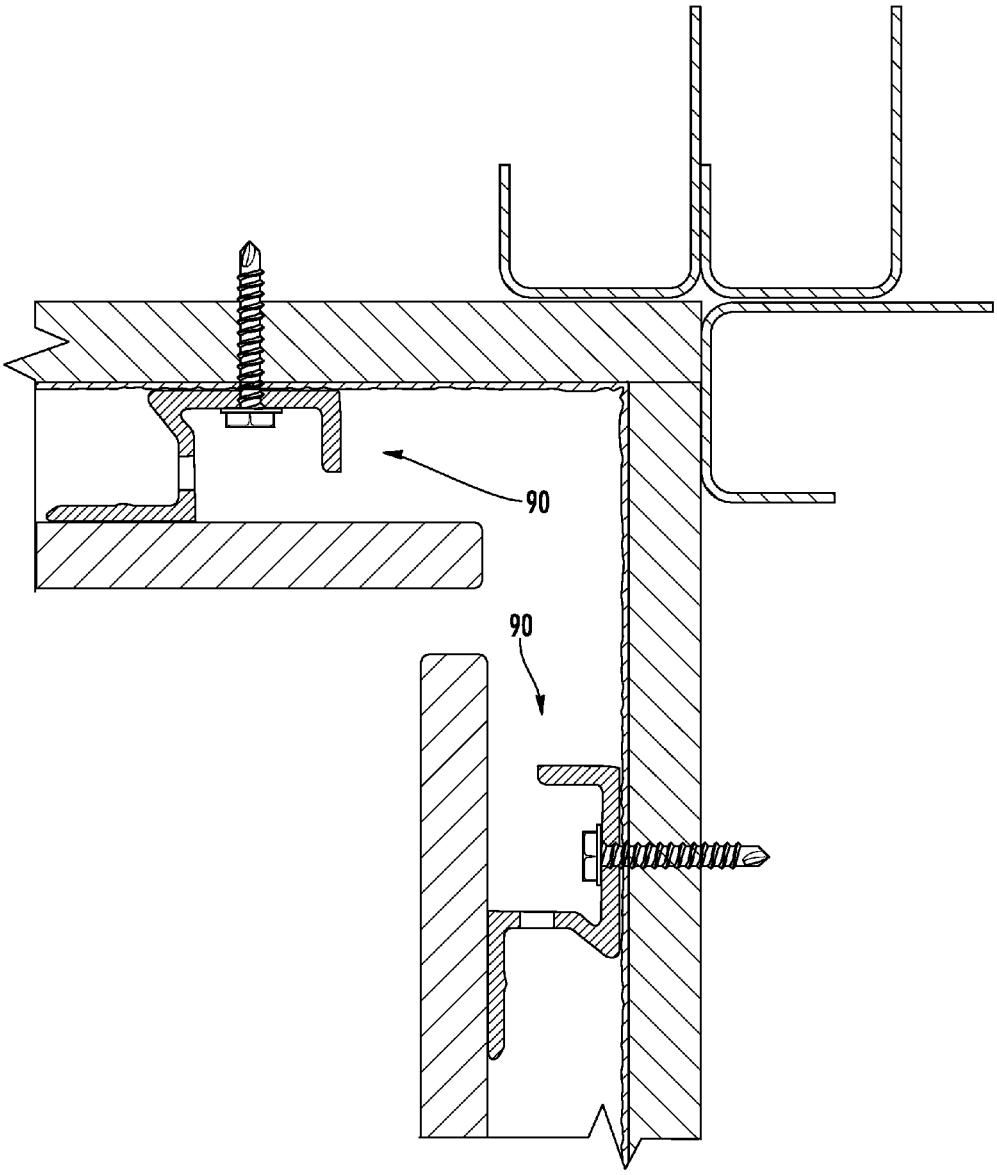
FIG. 7 is a sixth cross-sectional view of the first embodiment of the wall panel system shown in FIG. 1.
Figure 7A:
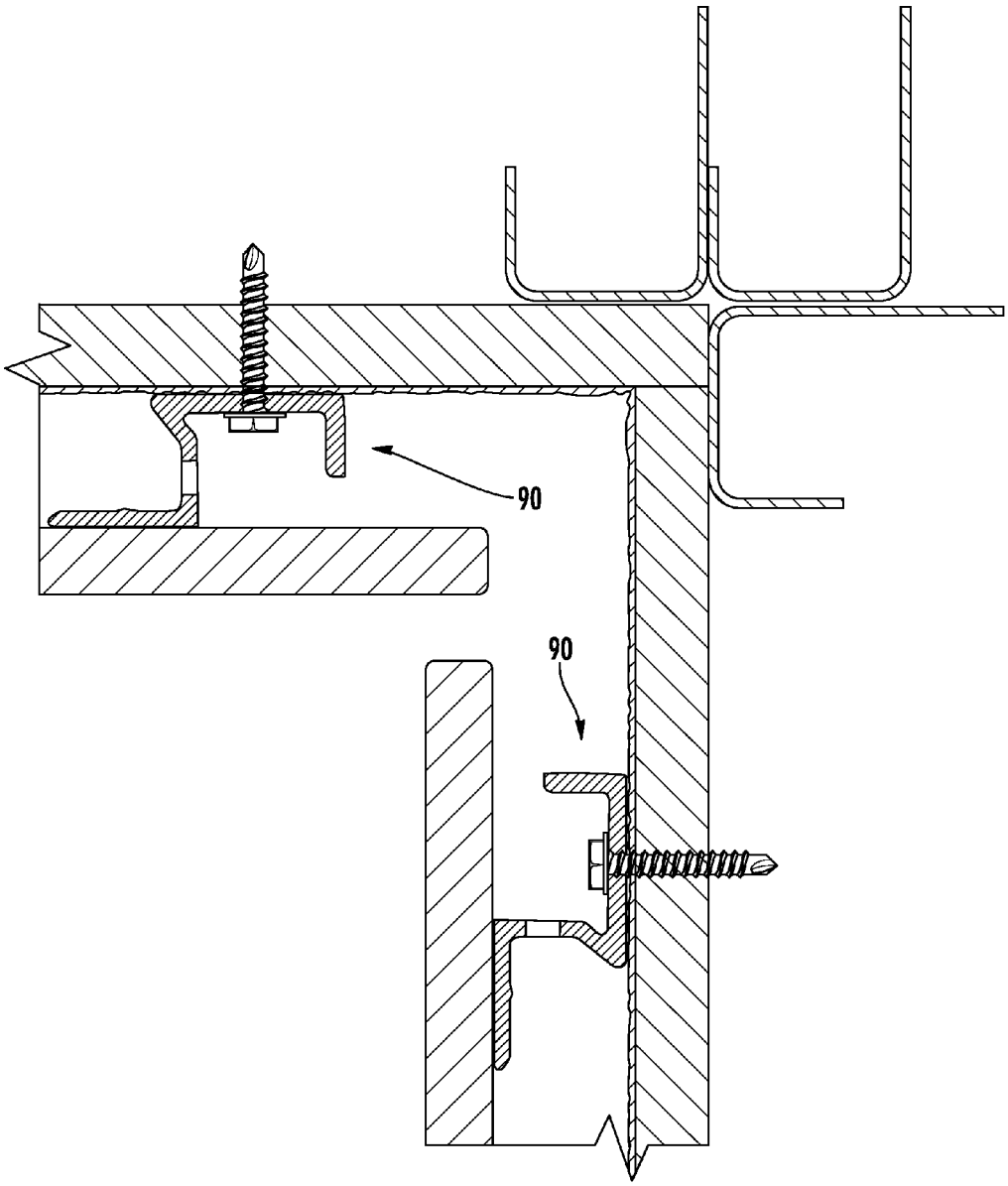
FIG. 7A is a sixth cross-sectional view of the first embodiment of the wall panel system shown in FIG. 1.
Figure 8:
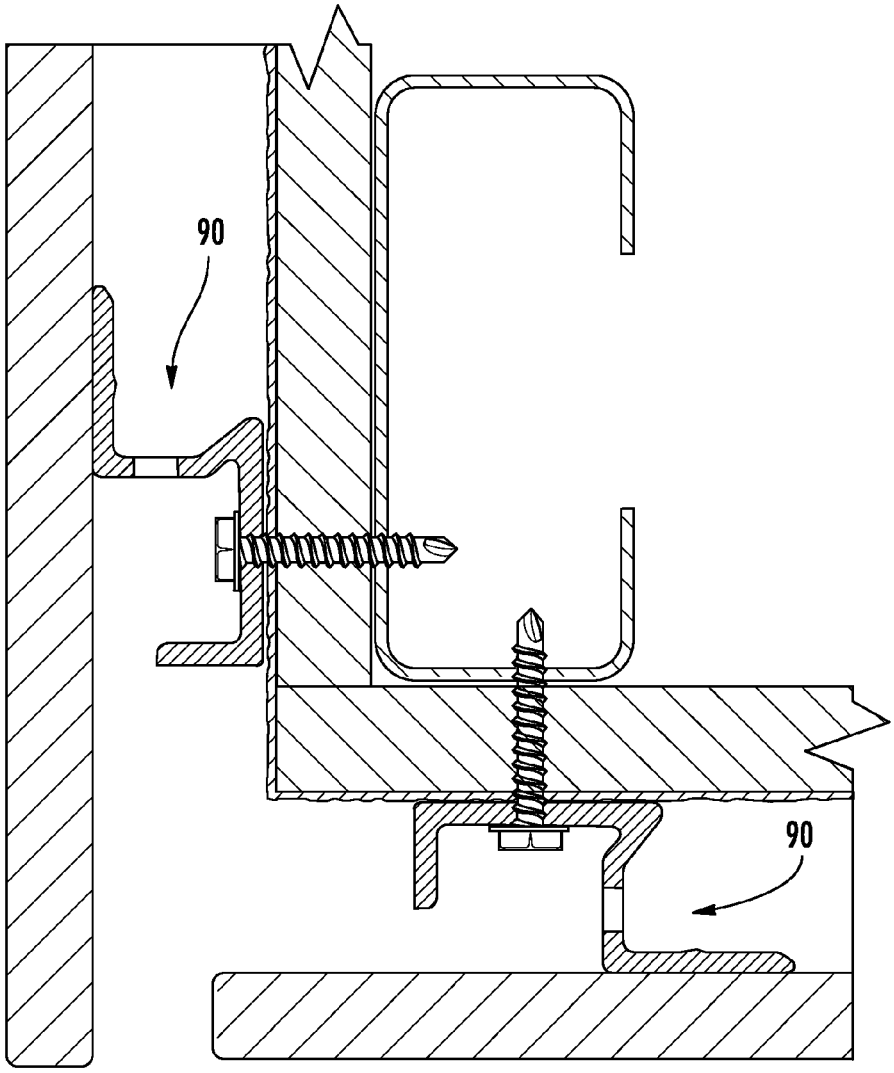
FIG. 8 is a seventh cross-sectional view of the first embodiment of the wall panel system shown in FIG. 1.
Figure 8A:
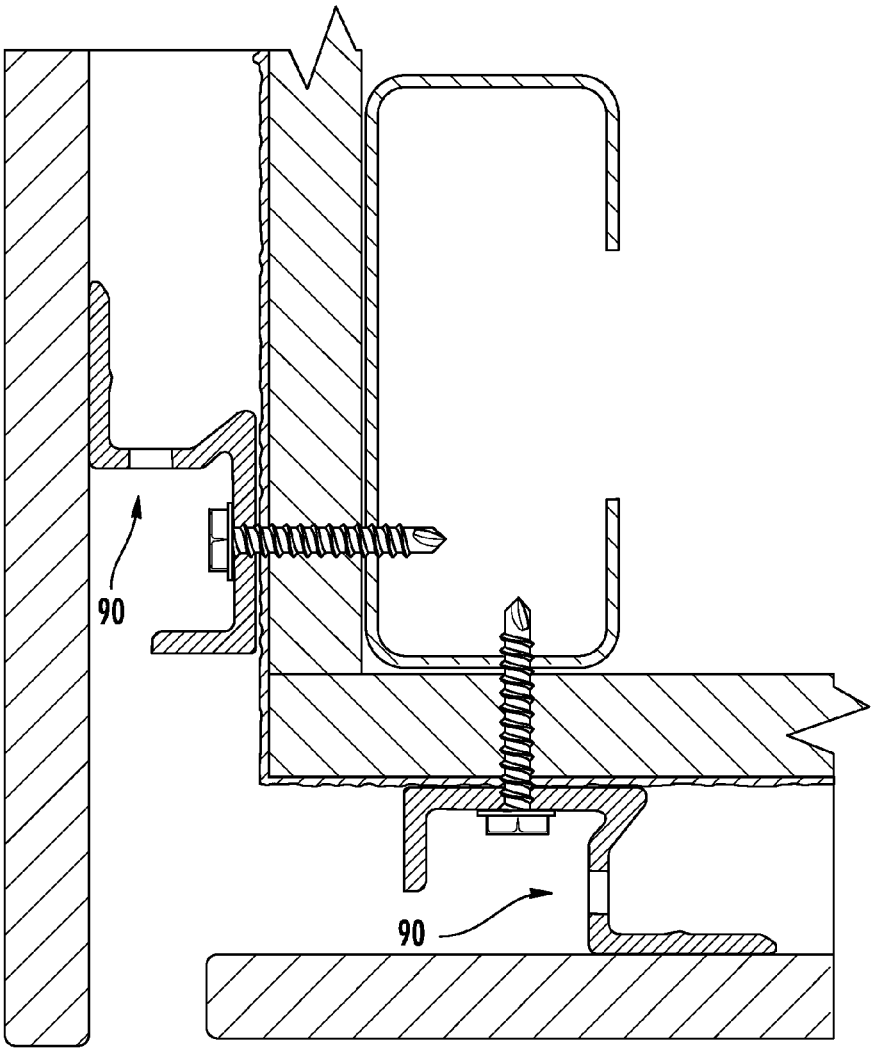
FIG. 8A is a seventh cross-sectional view of the first embodiment of the wall panel system shown in FIG. 1.

FIGS. 7 and 8 show vertical wall runners 90 to support the panel at different areas on the wall shown in FIG. 1. However, these vertical wall runners 90 are also optional, and not required to implement the wall panel system 10.

Figure 9:
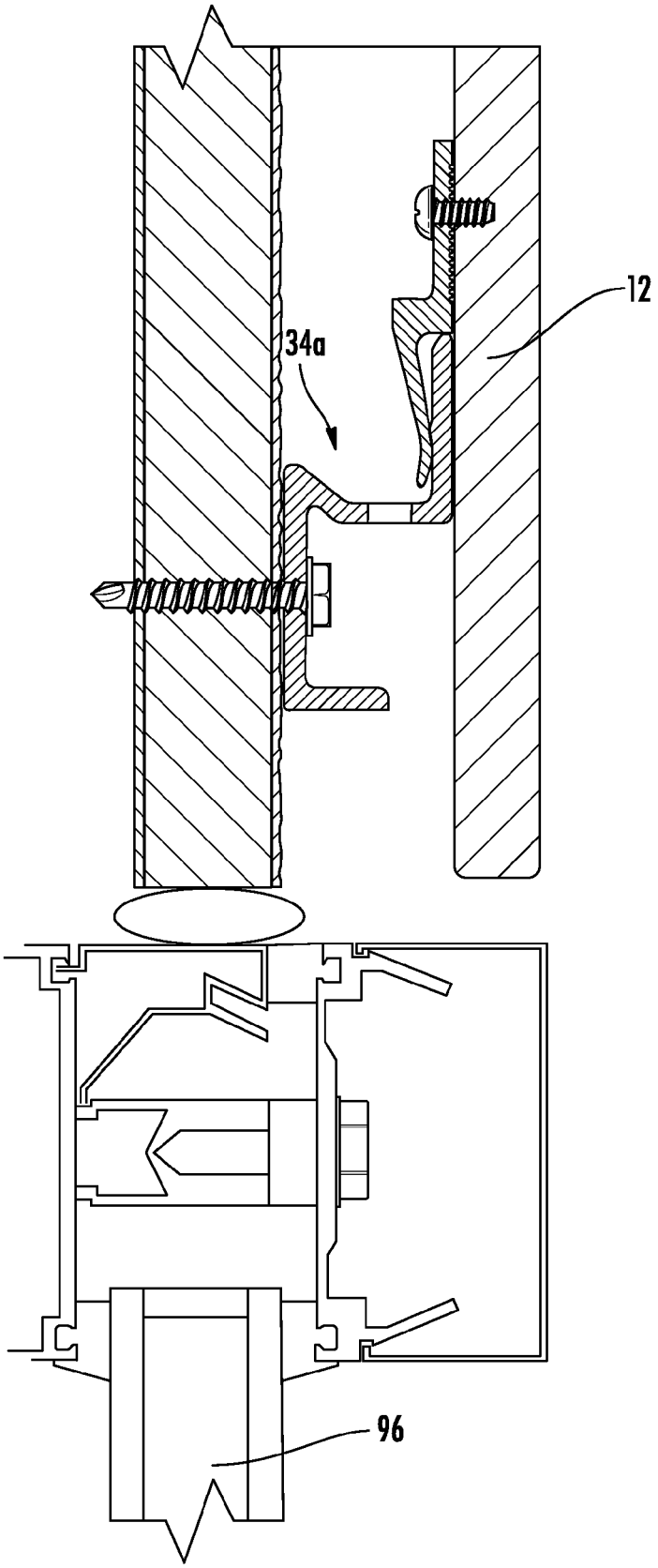
FIG. 9 is an eighth cross-sectional view of the first embodiment of the wall panel system shown in FIG. 1.
Figure 9A:
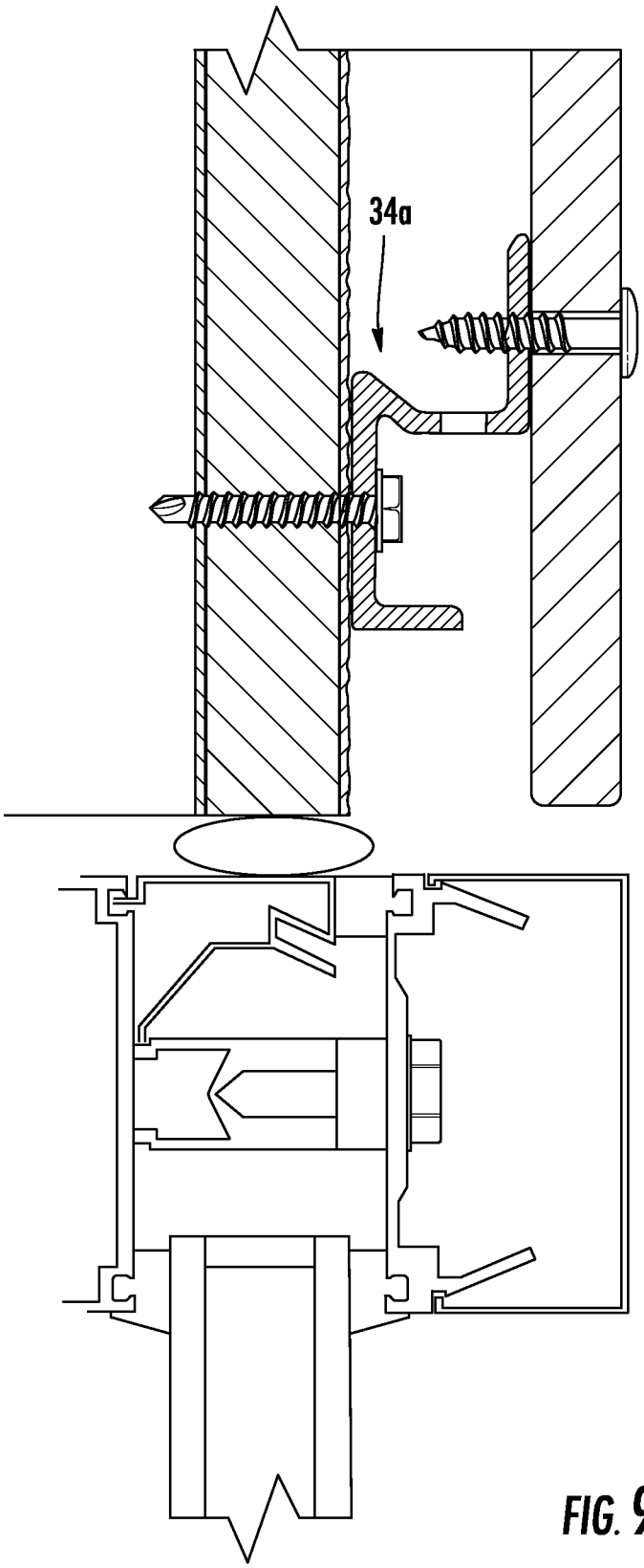
FIG. 9A is an eighth cross-sectional view of the first embodiment of the wall panel system shown in FIG. 1.
Figure 10:
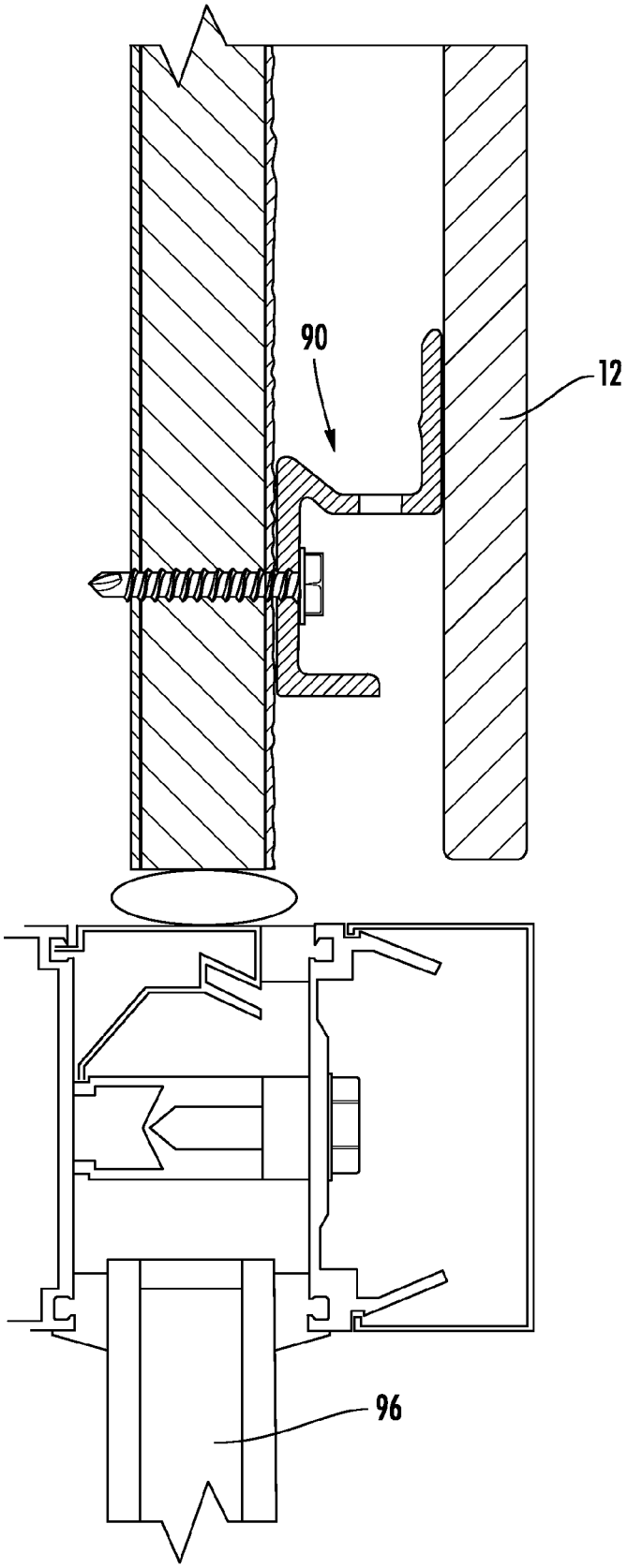
FIG. 10 is a ninth cross-sectional view of the first embodiment of the wall panel system shown in FIG. 1.
Figure 10A:
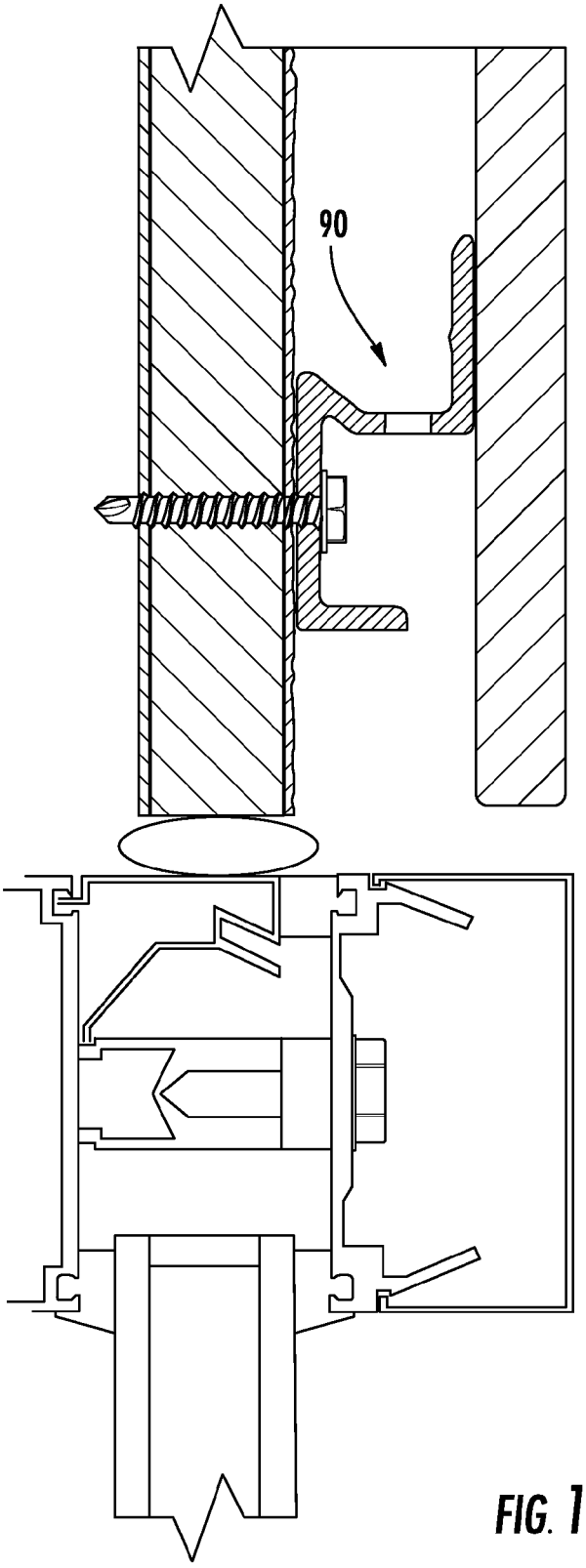
FIG. 10A is a ninth cross-sectional view of the first embodiment of the wall panel system shown in FIG. 1.
Figure 11:
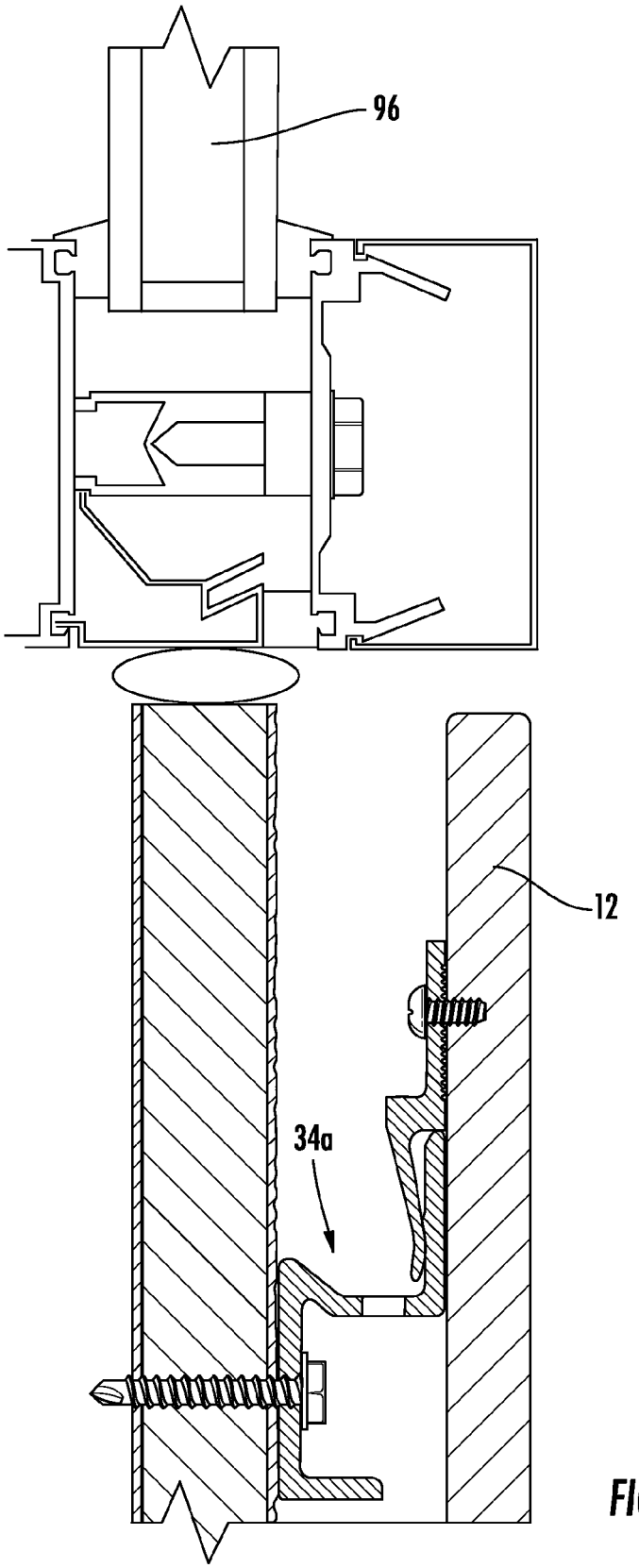
FIG. 11 is a tenth cross-sectional view of the first embodiment of the wall panel system shown in FIG. 1.
Figure 11A:
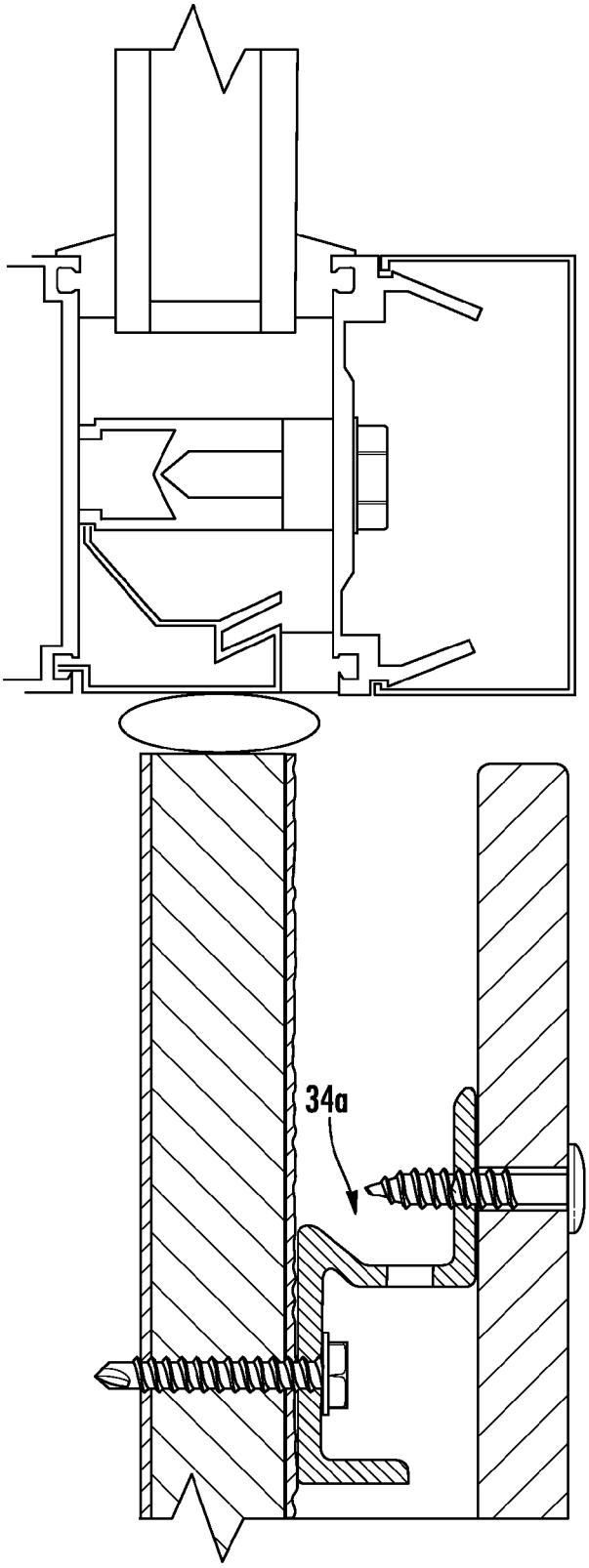
FIG. 11A is a tenth cross-sectional view of the first embodiment of the wall panel system shown in FIG. 1.

FIGS. 9-11 illustrate how the horizontal and vertical wall runners 34*a*, 90 are used to provide stability to the laterally adjacent panels 12 or vertically disposed panels 12 above and below the window 96. As indicated above, the vertical wall runners 90 shown in FIG. 19 is not required and is optional.

The plurality of wall panels 12 mounted to the wall 14 may have a flashing 98 (see FIG. 1) along the length of the upper panels 12 to mitigate entry of rainwater between the panel 12 and the wall 14. In this manner, the flashing 98 provides a consistent look with the other panels 12 in that the flashing 98 may have a gap 92 or reveal 20 consistent with the reveals 20 between laterally adjacent panels 12 and vertically adjacent panels 12.

The wall panel system 10 may be mounted to an exterior wall 14. The wall panel system 10 may be exposed to rainwater that enters between the panel 12 and the wall 14 through the reveals 20. The wall panel system 10 must either remove the rainwater by flowing the rainwater downward onto the ground 72 or allow sufficient airflow laterally and vertically in order to dry out the water and remove any moisture between the panel 12 and the wall 14 that may cause detrimental effects. In order to allow for sufficient airflow vertically and laterally as well as sufficient downward fall of water, the plurality of holes 66 may be a hole or an elongate slot. The hole may have a diameter of about 3/16 inch. If the hole 66 is an elongate slot, then the elongate slot may be about 3/16 inch in width and about ¾ inch in length. The holes 66 may be spaced apart about 3 inches from the adjacent hole 66 center to center. Moreover, the plurality of holes 66 may be formed along the entire length of spacers 64, 64*a*, as shown in FIGS. 16-18.

The clips 56, horizontal wall runners 34, 34*a* may be fabricated from an extrusion process and the holes 66 made through a subsequent drilling, stamping or machining process. The clips 56 and horizontal wall runners 34, 34*a* may be fabricated from a metallic material including but not limited to aluminum, steel and other materials that may be developed in the future or known in the art.

Referring now to FIGS. 2A-15A, the wall panel system 10*a* having an exposed screw 38 is shown. In contrast, the wall panel system 10 shown in FIGS. 2-15 illustrates attachment of the panel 12 via clips 56. In the wall panel system 10*a* shown in FIGS. 2A-15A, the panels 12 are directly secured to the prongs 52, 54 with screws 38. Preferably, only the prongs 52, 54 of the horizontal wall runners 34, 34*a* are directly attached to the panels 12 with the screws 38. However, it is also contemplated that the prongs 52, 54 of the vertical wall runners 84, 90 may be directly attached to the panels 12 with the screws 38 but as shown in FIGS. 2A-15A, the prongs 52, 54 of the vertical wall runners 84, 90 merely provide stability to the panel 12 in the event that the panels 12 are being pushed toward the wall 14. The vertical wall runners shown in FIGS. 3A, 5A, 7A, 8A, 10A, 13A, 14A, 15A are optional, and not required in the wall panel system 10*a* having exposed screws.

Figure 16:
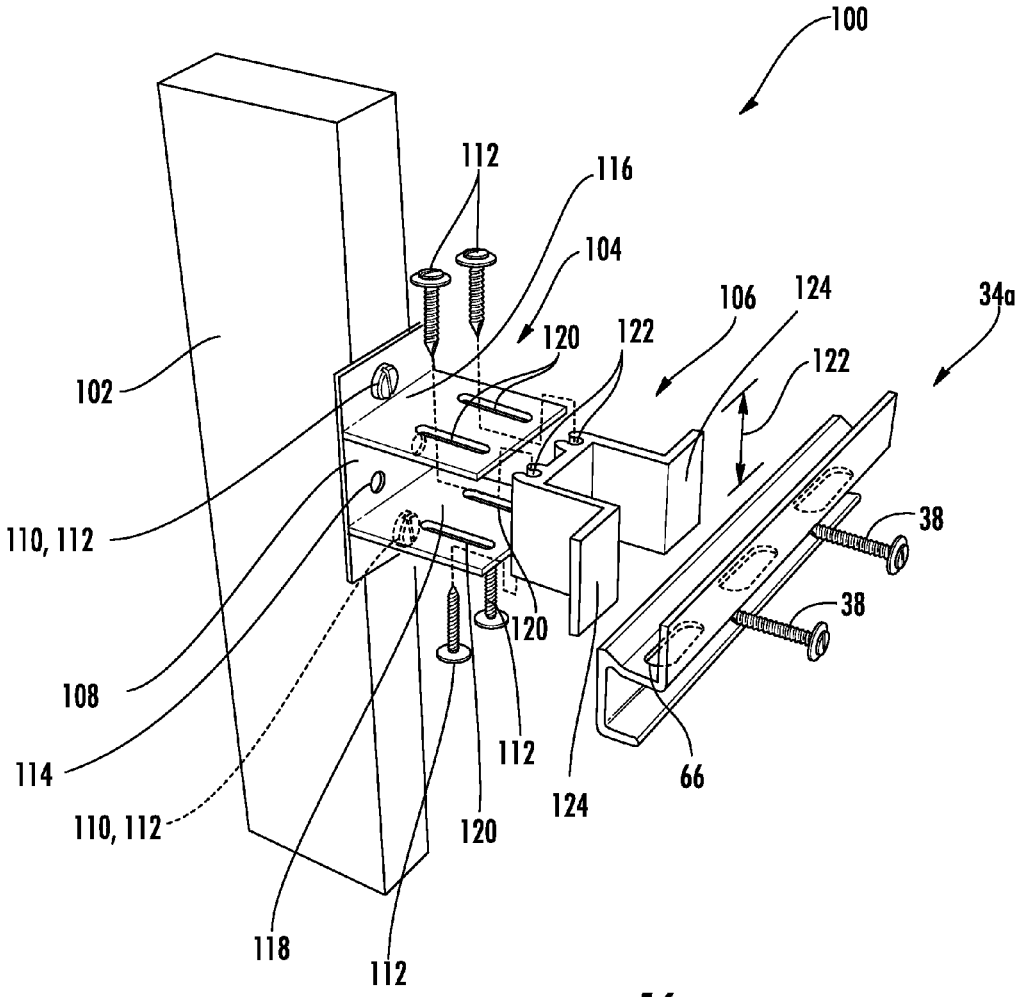
FIG. 16 is an exploded perspective view of a variable distance mounting device oriented to mount a horizontal wall runner.
Figure 17:
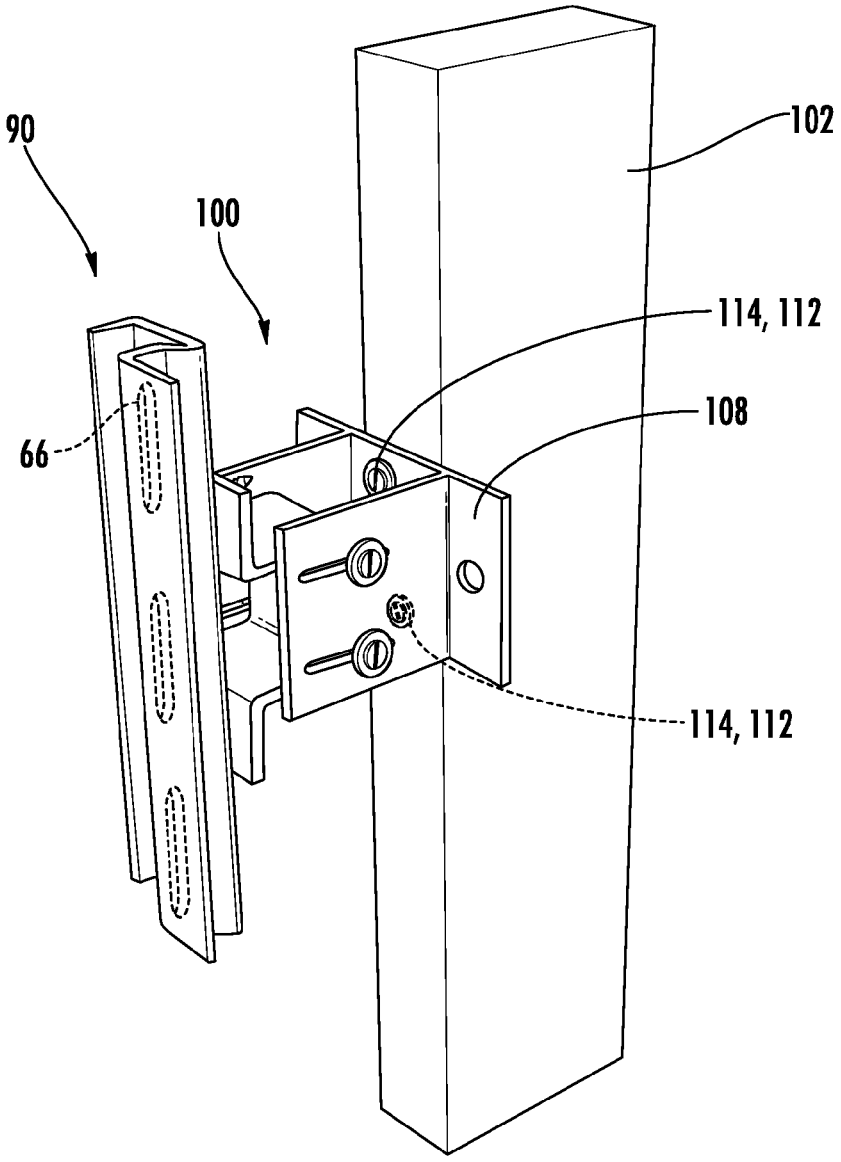
FIG. 17 is an assembled perspective view of the variable distance mounting device oriented to mount a vertical wall runner.
Figure 18:
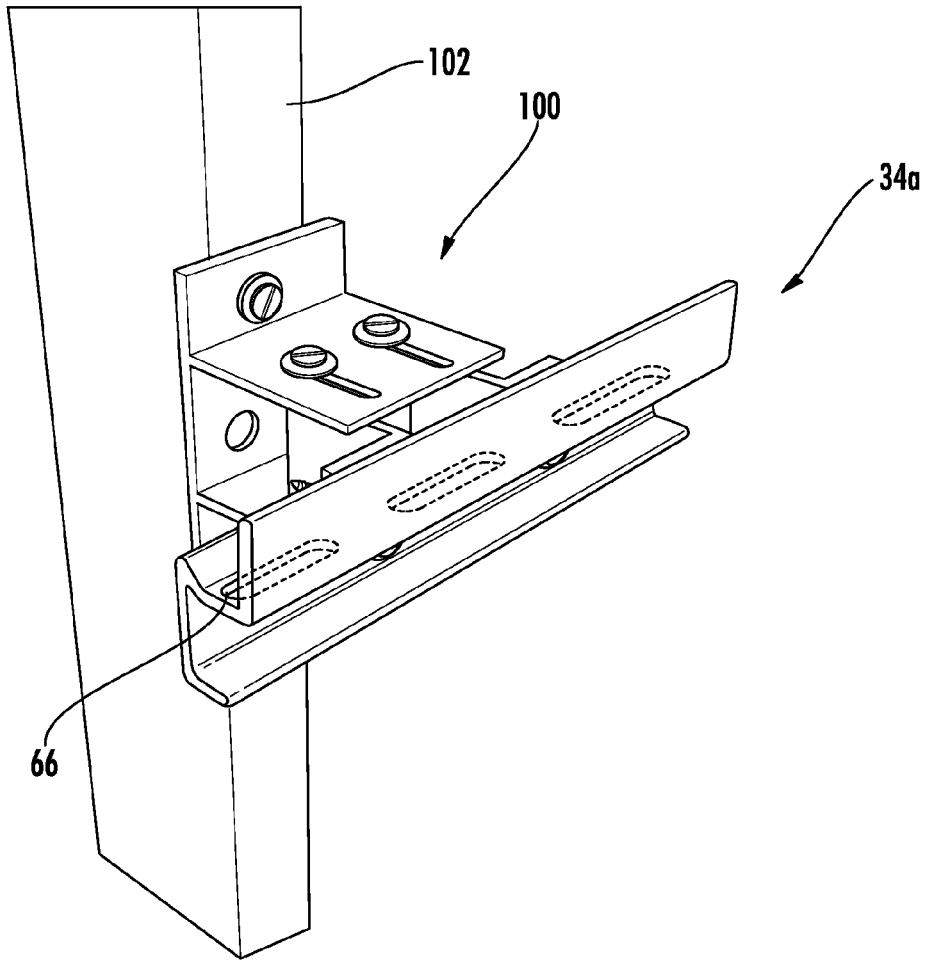
FIG. 18 is an assembled view of the variable distance device shown in FIG. 16.

Referring now to FIGS. 16-18, a variable distance mounting device 100 is shown. The variable distance mounting device 100 may be oriented to mount the horizontal wall runners 34, 34*a*. FIGS. 16-18 illustrate the horizontal wall runner 34*a* mounted to the stud 102. However, the vertical wall runner 90 may also be mounted to the stud 102 with the variable distance mounting device 100. FIG. 17 illustrates the variable distance mounting device 100 reoriented 90° to mount the vertical wall runner 90 to the stud 102. Although FIG. 17 illustrates the vertical wall runner 90 mounted to the stud 102, it is also contemplated that the variable distance mounting device 100 may be used to mount the vertical wall runner 90 to the stud 102. The variable distance mounting device 100 is shown as being mounted to the stud 102 directly. However, it is also contemplated that other materials may be interposed between the vertical distance mounting device 100 and the stud 102 including but not limited to a drywall or a vapor barrier 44.

The variable distance mounting device 100 may have a wall mount 104 and a sliding component 106. The wall mount 104 may have a base 108 with at least two holes 110 for mounting the horizontal wall runners 34, 34*a*. In particular, the two holes 110 are vertically aligned so that fasteners 112 can proceed through the holes 110 and mount to the vertical stud 102. The base 108 may have two additional holes 114 for mounting the vertical wall runners 84, 90 as shown in FIG. 17. In particular, the two holes 114 are horizontally aligned, when the variable distance mounting device 100 is oriented as shown in FIGS. 16, 18. However, the two holes 114 are vertically aligned to allow the base 108 to be mounted to the vertical stud 102 when the variable distance mounting device 100 is oriented in the direction shown in FIG. 17. With the base 108 securely mounted to the stud 102, a sliding component 106 may be inserted between first and second plates 116, 118. Each of the first and second plates 116, 118 may have elongate slots 120 for receiving fasteners 112. The sliding component 106 has two receiving holes 110 so that the threads of the screws 112 can be secured to the sliding component 106 and the holes 110. The sliding component 106 may also have a thickness 122 sufficiently large so that the fasteners 112 do not bump into each other as they are being tightened into the holes 114 from opposite ends. The sliding component 106 may additionally have one or more wings 124. The wings 124 preferably extend outward symmetrically to provide symmetrical support and force to the wall mount 104. The screws 38 that secure the runners 34, 34*a*, 84, 90 to the wall 14 are now used to secure the runners 34, 34*a*, 84, 90 to the wings 124.

The variable distance mounting device 100 allows the installer to provide for an adjustable distance between the back surface of the panel 12 to the outer surface of the wall 14 so that the space therebetween may be filled with material including but not limited to insulation. Preferably, the distance may be set to between about 3½ inches to about 5 inches. In this sense, the slot 120 may be about 2 inches long.

The panel 12 discussed herein may have a thickness between about 3/16" to about 1", and is preferably between about 5/16" to about ½". Along these lines, the thickness of the panels may be 5/16", ⅜" or ½". The horizontal and vertical wall runners 34, 34*a*, 84 and 90 may be fabricated from an aluminum material and may be anodized. The holes 66 have an inner slotted dimension of about ¾"×3/16" and be spaced apart about 1½ inches to about 4 inches (more preferably about 3 inches center to center) center to center from an immediately adjacent hole 66. The depth of the hole 66 may be 3/16". In the embodiments shown in FIGS. 2-15 and 2A-15A, a distance between the back surface of the panel 12 and the exterior surface of the wall or vapor barrier may be about 1". However, it is also contemplated that the distance therebetween may be greater than or less than 1" such as between about ½ inch to about 3 inches. The distal end of the panel 12 may be gapped away from a wall, a surface or another object about 1 inches. By way of example and not limitation, the gap or distance 92 shown in FIG. 14 may be about 1 inches. However, such distance may be increased or decreased by elongating or cutting the panel 12 short. The distance 92 may be zero with the wall or increased to any distance but is preferably limited to about 2 inches and is more preferably limited to 1". The figures show other gaps between the distal end of the panel to other surfaces and the gaps may be increased or decreased as desired. In relation to the variable distance mounting device 100, the base and the sliding component may be fabricated from a steel material including but limited to exterior grade stainless steel.

In the wall panel systems 10, 10*a* described herein, lateral air flow may be encouraged by not using any vertical wall runners. However, if vertical wall runners are utilized, then the vertical wall runners are formed with the holes 66 described herein.

The above description is given by way of example, and not limitation. Given the above disclosure, one skilled in the art could devise variations that are within the scope and spirit of the invention disclosed herein, including various ways of fabricating the components. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An exterior wall panel system which mitigates pooling of water and mold, the system comprising:

upper and lower row of panels having a thickness between about ⅛ inch to about 1½ inches, the upper and lower row of panels disposable adjacent to each other in a single plane;

a horizontal wall runner attachable to a wall and the upper and lower row of panels, the horizontal wall runner having a base, a first panel attachment member and a first spacer that attaches the first panel attachment member to the base, the first spacer having:

a plurality of holes along at least a portion of a length of the horizontal wall runner for directing water introduced between the plurality of panels and the wall below the horizontal wall runner;

wherein the upper row of panels has second panel attachment members that are attachable to the first panel attachment member for securing the upper row of panels to the wall;

wherein the first spacer further has a funnel shaped cross sectional configuration along at least the portion of the length of the horizontal wall runner and the plurality of holes are formed at a lowest most portion of a trough of the funnel shaped cross sectional configuration;

wherein the horizontal wall runner has a third panel attachment member attachable to fourth panel attachment members of the lower row of panels for securing the lower row of panels to the wall and a second spacer wherein the second spacer has a funnel-shaped cross sectional configuration and a plurality of holes.

2. The system of claim 1 wherein the first panel attachment member is an upwardly directed prong which is removably attachable to the second panel attachment member of the panel.

3. The system of claim 1 wherein the second panel attachment member is a clip attached to a back side of the panel wherein the first attachment member is held between the clip and the panel.

4. The system of claim 1 wherein the panels fabricated from phenolic.

5. The system of claim 1 wherein the horizontal wall runner is fabricated from aluminum.

6. An exterior wall panel system which mitigates pooling of water and mold, the system comprising:

upper and lower row of panels having a thickness between about ⅛ inch to about 1½ inches, the upper and lower row of panels disposable adjacent to each other so that a front face of the upper and lower row of panel are in a single plane;

a horizontal wall runner attachable to a wall and the upper and lower row of panels, the horizontal wall runner having a base, a first panel attachment member, a first spacer that attaches the first panel attachment member to the base, a third panel attachment member, a second spacer that attaches the third panel attachment member to the base, the first and second spacers each having:

a plurality of holes along at least a portion of a length of the horizontal wall runner for directing water introduced between the plurality of panels and the wall below the horizontal wall runner;

a funnel shaped cross sectional configuration along at least the portion of the length of the horizontal wall runner and the plurality of holes are formed at a lowest most portion of a trough of the funnel shaped cross sectional configuration;

the upper row of panels having second panel attachment members that are attachable to the first panel attachment member for securing the upper row of panels to the wall;

the lower row of panels having fourth panel attachment members that are attachable to the third panel attachment member for securing the lower row of panels to the wall.

* * * * *